US008520869B2

(12) United States Patent
Fujise

(10) Patent No.: US 8,520,869 B2
(45) Date of Patent: Aug. 27, 2013

(54) PIEZOELECTRIC ACOUSTIC TRANSDUCER

(75) Inventor: Akiko Fujise, Osaka (JP)

(73) Assignee: Panasonic Corporation, Osaka (JP)

( * ) Notice: Subject to any disclaimer, the term of this patent is extended or adjusted under 35 U.S.C. 154(b) by 140 days.

(21) Appl. No.: 13/322,621

(22) PCT Filed: Mar. 28, 2011

(86) PCT No.: PCT/JP2011/001841
§ 371 (c)(1),
(2), (4) Date: Nov. 28, 2011

(87) PCT Pub. No.: WO2011/121985
PCT Pub. Date: Oct. 6, 2011

(65) Prior Publication Data

US 2012/0099746 A1 Apr. 26, 2012

(30) Foreign Application Priority Data

Mar. 29, 2010 (JP) ..... 2010-076083

(51) Int. Cl.
*H04R 25/00* (2006.01)

(52) U.S. Cl.
USPC ..... 381/190; 381/173

(58) Field of Classification Search
USPC ..... 381/369, 173, 178, 190, 191; 310/311, 310/322
See application file for complete search history.

(56) References Cited

U.S. PATENT DOCUMENTS

| | | | | |
|---|---|---|---|---|
| 3,894,198 | A * | 7/1975 | Murayama et al. | 381/114 |
| 5,804,906 | A | 9/1998 | Tsutsumi | |
| 6,453,050 | B1 | 9/2002 | Ogura et al. | |
| 2003/0202672 | A1 * | 10/2003 | Yamauchi et al. | 381/190 |
| 2004/0205949 | A1 * | 10/2004 | Takeshima et al. | 29/25.35 |

FOREIGN PATENT DOCUMENTS

| | | |
|---|---|---|
| JP | 58-44899 | 3/1983 |
| JP | 60-38000 | 3/1985 |
| JP | 62-6600 | 1/1987 |
| JP | 63-102599 | 5/1988 |
| JP | 5-9100 | 2/1993 |
| JP | 6-125597 | 5/1994 |
| JP | 2001-160999 | 6/2001 |
| JP | 2002-315095 | 10/2002 |
| JP | 3565560 | 6/2004 |
| JP | 2005-286690 | 10/2005 |

* cited by examiner

*Primary Examiner* — Tuan D Nguyen
(74) *Attorney, Agent, or Firm* — Wenderoth, Lind & Ponack, L.L.P.

(57) ABSTRACT

Provided is a piezoelectric type loudspeaker capable of reproducing a high sound pressure in a limited space, without increasing a voltage applied to a piezoelectric element in a bass range. A plurality of piezoelectric diaphragms are disposed in parallel, and coupled to one another in a thickness direction of the diaphragms via a coupling member, and a polarity of the piezoelectric element and the applied voltage are defined so as to cause deformations in opposite directions from each other. One diaphragm includes an edge on a periphery, and operates as a sound wave radiation surface. At least one diaphragm is fixed to a housing side via a fixing member. Series resistance is connected to the piezoelectric element on the piezoelectric diaphragm fixed to the housing side.

20 Claims, 35 Drawing Sheets

PIEZOELECTRIC ACOUSTIC TRANSDUCER

TECHNICAL FIELD

The present invention relates to a piezoelectric acoustic transducer, and more particularly to a piezoelectric acoustic transducer which achieves both space-saving and enhancement of bass reproduction capability.

BACKGROUND ART

Conventional piezoelectric acoustic transducers ("piezoelectric type loudspeaker") use natural resonance of a diaphragm and a bending deformation of the diaphragm, which uses the converse piezoelectric effect, to reproduce sounds. This raises a problem that, as compared to electrodynamic loudspeakers having a diaphragm which has equivalent area, the conventional piezoelectric acoustic transducers have less bass reproduction capability. As means which overcomes such problem, there are piezoelectric type loudspeakers which have an edge and damper formed between a frame and a diaphragm (e.g., see Patent Literature 1).

FIG. 44 is an external view of a piezoelectric type loudspeaker disclosed in Patent Literature 1. A piezoelectric type loudspeaker 10 includes an outer frame 21, an inner frame 22, a piezoelectric element 30, diaphragms 41, 42, 43, and 44, dampers 51, 52, 53, 54, 55, 56, 57, and 58, and edges 61, 62, 63, and 64. In the piezoelectric type loudspeaker 10, application of an AC signal to the piezoelectric element 30 in a direction perpendicular to a main surface causes, because of the converse piezoelectric effect, the piezoelectric element 30 to expand or contract in a main surface direction, and therefore bending deformations occur with respect to the diaphragms 41 to 44. As a result, the piezoelectric type loudspeaker 10 generates a sound wave in the direction perpendicular to the main surface.

The piezoelectric type loudspeaker 10 having the above configuration is able to reduce stiffness of a support system by including the dampers 51 to 58 and the edges 61 to 64. Therefore, lowest resonant frequency can be reduced, and the limitation of the bass reproduction can be ameliorated as compared to the conventional piezoelectric type loudspeakers.

CITATION LIST

Patent Literature

[PATENT LITERATURE 1] Japanese Laid-Open Patent Publication No. 2001-160999

SUMMARY OF THE INVENTION

Problems to be Solved by the Invention

However, obtaining sufficient sound volume for bass in the piezoelectric type loudspeaker 10 having the above configuration requires application of a high voltage to increase an amount of expansion and contraction of the piezoelectric element 30. This raises the following two problems. First, if, because of the application of the high voltage, an electric field exceeding an electrically allowable input range of the piezoelectric element 39 is applied to the piezoelectric element 30, a problem of deterioration in performance of the piezoelectric element 30 occurs. Second, magnitude of a bending deformation of the piezoelectric element 30 exceeds critical fracture stress of a piezoelectric material, and thereby a problem of crack failure occurs.

Therefore, an object of the present invention is to provide a piezoelectric acoustic transducer which is able to reproduce a high sound pressure in a limited space, without increasing a voltage applied to the piezoelectric element in a bass range.

Solution to the Problems

In order to achieve the above object, the present invention employs the following configurations.

A piezoelectric acoustic transducer of the present invention includes a housing having an opening formed in a wall surface; a plurality of diaphragms including at least a first piezoelectric diaphragm and a second piezoelectric diaphragm which vibrate in opposite phases by having a voltage applied thereto; at least one coupling member for coupling the first piezoelectric diaphragm and the second piezoelectric diaphragm with each other in a thickness direction; and a fixing member for fixing at least one of the first and second piezoelectric diaphragms to the housing, wherein one of the plurality of diaphragms is disposed in the opening of the housing so that a surface on one side faces outside the housing, and a surface on the other side faces inside the housing, and the one of the plurality of diaphragms radiating a sound wave by vibrating at amplitude obtained by combining amplitude of the first and second piezoelectric diaphragms, each of the first piezoelectric diaphragm and the second piezoelectric diaphragm includes a substrate and at least one piezoelectric element disposed on at least one of a front surface and a rear surface of the substrate, the piezoelectric element expanding or contracting by having a voltage applied thereto, and electric resistance is connected in series to the at least one piezoelectric element.

Preferably, a value of the electric resistance is defined by electrostatic capacity of the piezoelectric element and either a second lowest resonant frequency or a third lowest resonant frequency, among mechanical resonant frequencies of the piezoelectric acoustic transducer.

Also, at least one of the diaphragms has an edge made of a pliable material on a periphery, the at least one of the diaphragms operates as a sound wave radiation surface, and the edge is connected to an external frame.

A value of the electric resistance is defined by electrostatic capacity of the piezoelectric element and a lowest frequency among frequencies having both positive and negative values for magnitudes of displacements in a sound wave radiation direction on the diaphragm, which operates as the sound wave radiation surface, at points on the diaphragm when the electric resistance is not connected.

The electric resistance is connected in series to the piezoelectric element on the piezoelectric diaphragm fixed by the fixing member.

Also, the electric resistance is formed on a front surface of or inside the coupling member. Also, the electric resistance may be formed on a front surface of the substrate. Also, the electric resistance may be formed on a front surface of or inside the external frame.

As an example, the first piezoelectric diaphragm may be disposed in the opening of the housing and operates as a radiating plate. In this case, the second piezoelectric diaphragm is accommodated inside the housing. As another example, the plurality of diaphragms may include a radiating plate which vibrates at combined amplitude transmitted from the first piezoelectric diaphragm, the radiating plate being connected to the first piezoelectric diaphragm in a positional relationship in which the radiating plate is shifted from the plurality of diaphragms in the thickness direction. In this case, the first and second piezoelectric diaphragms are accommodated inside the housing.

Also, the radiating plate and the first piezoelectric diaphragm may be disposed so as to face each other. The piezoelectric acoustic transducer may further include a connecting member for connecting with each other the radiating plate and a portion of the first piezoelectric diaphragm where amplitude is largest. Because of this, vibrations of the first and second piezoelectric diaphragms can be efficiently transmitted to the radiating plate.

The fixing member may fix the second piezoelectric diaphragm to inner wall surfaces of the housing. The piezoelectric acoustic transducer may further include a fixing member, which extends into and out of the housing through a gap provided in the housing, for fixing the second piezoelectric diaphragm to a rigid body outside the housing. Because of this, the vibrations of the first and second piezoelectric diaphragms can be prevented from being transmitted to the housing.

Also, the first and second piezoelectric diaphragms may each be formed in a substantially rectangular shape having long sides and short sides. The coupling member may be a member having an elongated shape, extending along the short sides of the first and second piezoelectric diaphragms to couple the short sides of the first and second piezoelectric diaphragms.

Also, the first and second piezoelectric diaphragms may each be formed in a substantially rectangular shape. The coupling member may couple corners of the first and second piezoelectric diaphragms. In addition, a bending rigidity of the coupling member in a direction intersecting with a main surface of the radiating plate may be larger than a bending rigidity of the first and second piezoelectric diaphragms in a main surface direction. Because of this, a deformation of the coupling member due to the vibrations of the first and second piezoelectric diaphragms can be reduced.

Also, each of the first piezoelectric diaphragm and the second piezoelectric diaphragm may include a substrate and at least one piezoelectric element disposed on at least one of a front surface and a rear surface of the substrate, the piezoelectric element expanding or contracting by having a voltage applied thereto. The first and second piezoelectric diaphragms may be bimorph type piezoelectric diaphragms each having piezoelectric elements mounted on both surfaces of the substrate, or may be monomorph type piezoelectric diaphragms each having the piezoelectric element mounted only on one surface of the substrate.

Also, wiring for connecting a signal source and the piezoelectric element with each other may be printed on the substrate surface upon which the piezoelectric element is disposed. Also, the wiring may extend from the signal source, passing through each of the first and second piezoelectric diaphragms from one side to the other side, and establish continuity between the piezoelectric element of the first piezoelectric diaphragm and the piezoelectric element of the second piezoelectric diaphragm.

Furthermore, the wiring may pass through a through hole formed on a surface of the coupling member or inside the coupling member, and extend from the one side of each of the first and second piezoelectric diaphragms to the other side. Furthermore, the piezoelectric acoustic transducer may be comprised of a pliable material, and include a sealing member for sealing a gap between the radiating plate and the opening of the housing.

Advantageous Effects of the Invention

According to the present invention described above, by coupling a plurality of piezoelectric diaphragms to one another in a thickness direction and causing bending deformations in opposite directions, a piezoelectric type loudspeaker which allows reproduction of a high sound pressure without increasing a voltage applied to a piezoelectric element can be provided. Also, according to the present invention, connection of electric resistance in series to a piezoelectric element mounted on a piezoelectric diaphragm that does not contribute to radiation of the sound wave, among the plurality of piezoelectric diaphragms, improves power efficiency in a high frequency band without providing a signal input circuit per diaphragm.

DESCRIPTION OF EMBODIMENTS

Before describing specifics of a piezoelectric acoustic transducer ("piezoelectric type loudspeaker") according to embodiments of the present invention, characteristics of the following components which will be described in each embodiment are described all together.

The piezoelectric type loudspeaker of the present invention is a construct which includes piezoelectric elements, substrates, coupling members, an edge, and electric resistance. The piezoelectric elements are each made of a piezoelectric material having laminar form, and on two main surfaces thereof, have electrode layers each made of a conductive material. The substrates are each formed of a lamination material made of a conductive material or an insulating material having, on at least one main surface, an electrode layer made of a conductive material. One main surface of each piezoelectric element is affixed to one main surface of the corresponding substrate. The coupling members are each made of an insulating material such as a resin, and affixed to main surfaces of piezoelectric diaphragms in regions where piezoelectric diaphragms are separated from each other. In addition, preferably, the coupling members have high Young's modulus and low density to the substrates. Preferably, the edge has physical properties and a shape which do not considerably inhibit bending deformations of the substrates, and examples of which are a laminate material and a pliable material such as urethane rubbers. The electric resistance is made of a conductive material such as an alloy, a composite of metal and a resin, or carbon. A housing is a component to which the piezoelectric type loudspeaker is attached, and have space therein. A fixing member is a component which fixes the piezoelectric type loudspeaker to the housing.

Hereinafter, the piezoelectric type loudspeaker according to each embodiment of the present invention will be described in detail with reference to the accompanying drawings.

First Embodiment

Figure 1A:
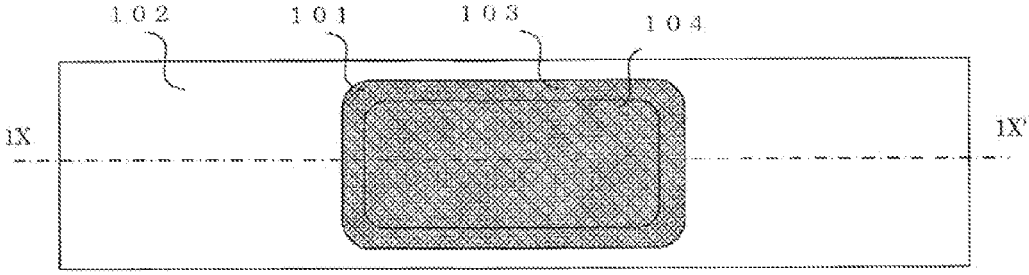
FIG. 1A is a top view of a piezoelectric type loudspeaker 101 according to a first embodiment.
Figure 1B:
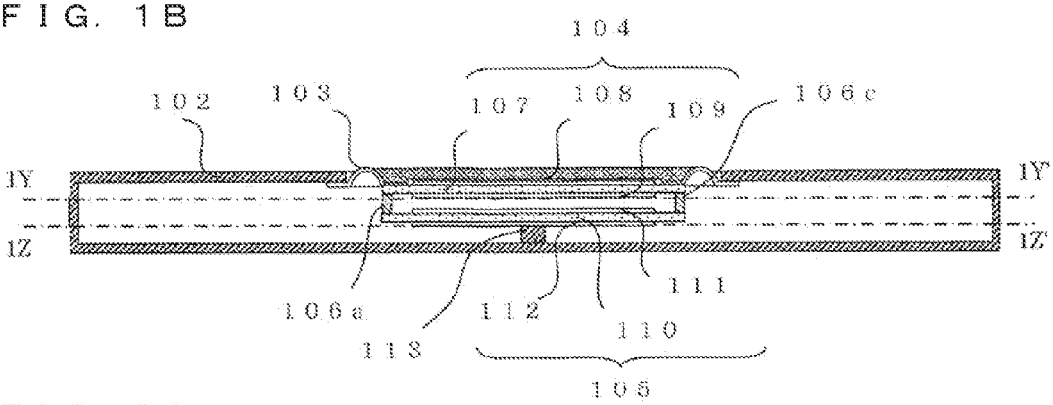
FIG. 1B is a sectional view taken from a plane parallel to a sound wave radiation direction in the piezoelectric type loudspeaker 101 shown in FIG. 1A.

Referring to FIGS. 1A and 1B, a structure of a piezoelectric type loudspeaker 101 according to a first embodiment will be described. FIG. 1A is a top view of the piezoelectric type loudspeaker 101 according to the first embodiment. FIG. 1B is a sectional view taken from a plane parallel to a sound wave radiation direction in the piezoelectric type loudspeaker 101 shown in FIG. 1A. In FIG. 1A, of components of a housing 102 and the piezoelectric type loudspeaker 101, an upper surface of an upper piezoelectric diaphragm 104 is shown. Also, FIG. 1B shows a sectional view of the piezoelectric type loudspeaker 101 shown in FIG. 1A, taken along a line 1X-1X'.

In FIG. 1B, the piezoelectric type loudspeaker 101 mainly includes the upper piezoelectric diaphragm 104, a lower piezoelectric diaphragm 105, coupling members 106*a*, 106*b*, 106*c*, and 106*d*, and an edge 103. The piezoelectric type loudspeaker 101 has a left-right symmetric structure about a centerline (not shown) of FIG. 1B. The upper piezoelectric diaphragm 104 may be referred to as first piezoelectric diaphragm, and the lower piezoelectric diaphragm 105 may be referred to as second piezoelectric diaphragm.

The housing 102 is in a substantially parallelepiped shape having space in which the diaphragm is accommodated. Also, an opening is provided in a wall on a front surface side of the housing 102. Since the piezoelectric type loudspeaker 101 according to the first embodiment is mounted in, for example, a flat-screen television, the thickness (a dimension of the FIG. 1B in the up-down direction) is extremely small as compared to the length and width. In addition, the upper piezoelectric diaphragm 104 is disposed in the opening of the housing 102 so that a surface of which on one side faces outside the housing 102 and a surface of which on the other side faces inside the housing 102. The upper piezoelectric diaphragm 104 functions as a radiating plate which radiates a sound wave. On the contrary, the lower piezoelectric diaphragm 105 is accommodated within the internal space of the housing 102.

The upper piezoelectric diaphragm 104 and the lower piezoelectric diaphragm 105 are flat plate-shaped members having a substantially rectangular shape and each diaphragm functions as a diaphragm which vibrates by having a voltage applied thereto. The upper piezoelectric diaphragm 104 and the lower piezoelectric diaphragm 105 are connected to each other at four substantially angled portions via the coupling members 106*a*, 106*b*, 106*c*, and 106*d*. The lower piezoelectric diaphragm 105 is connected, at a center portion of a lower surface thereof, to a rear surface of the housing 102 via a fixing member 113. Also, the edge 103 is connected to an outer periphery of the upper piezoelectric diaphragm 104. The edge 103 is connected to the front surface of the housing 102.

The upper piezoelectric diaphragm 104 and the lower piezoelectric diaphragm 105 are bimorph type piezoelectric diaphragms each having piezoelectric elements mounted on both surfaces of the substrate. That is, the upper piezoelectric diaphragm 104 includes a substrate 107, a piezoelectric element 108 mounted on an upper surface of the substrate 107, and a piezoelectric element 109 mounted on a lower surface of the substrate 107. Likewise, the lower piezoelectric diaphragm 105 includes a substrate 110, a piezoelectric element 111 mounted on an upper surface of the substrate 110, and a piezoelectric element 112 mounted on a lower surface of the substrate 110. While the upper piezoelectric diaphragm 104 and lower piezoelectric diaphragm 105 according to the first embodiment are given by way of example as bimorph type piezoelectric diaphragms each having the piezoelectric elements mounted on both surfaces of the substrate, monomorph type piezoelectric diaphragms each having the piezoelectric element mounted only on one surface of the substrate may be employed.

Figure 2A:
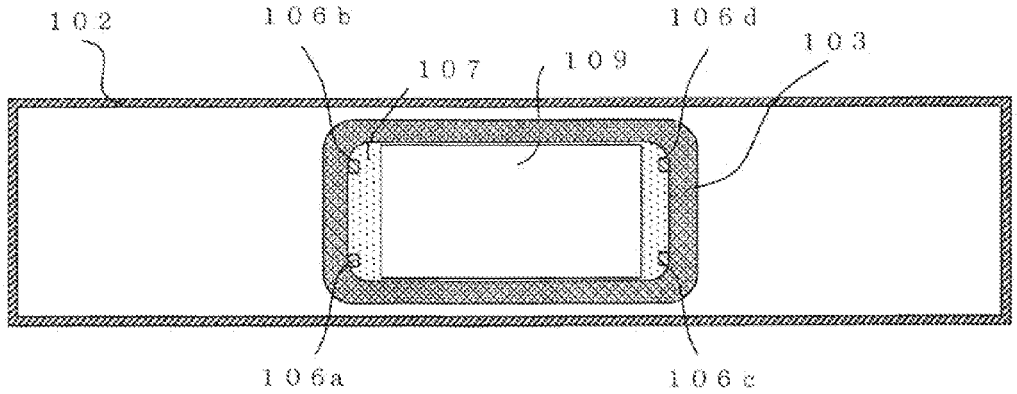
FIG. 2A is a bottom sectional view of the piezoelectric type loudspeaker 101 shown in FIG. 1B, taken along a line 1Y-1Y'.
Figure 2B:
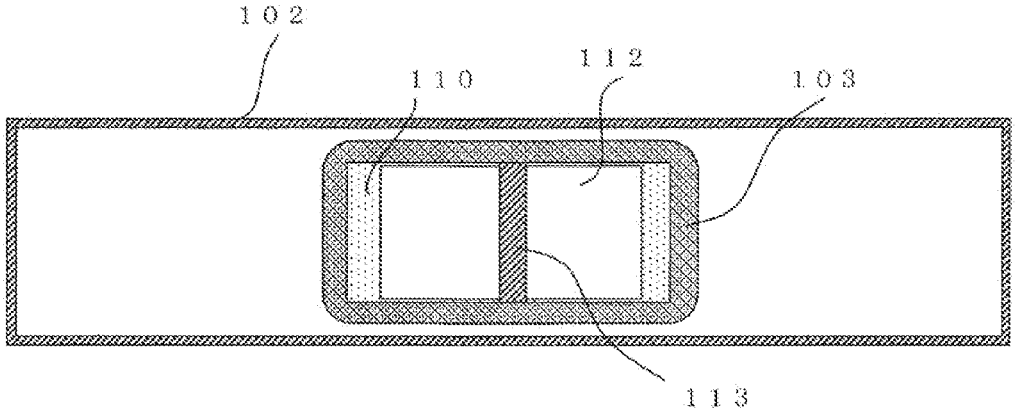
FIG. 2B is a bottom sectional view of the piezoelectric type loudspeaker 101 shown in FIG. 1B, taken along a line 1Z-1Z'.

FIGS. 2A and 2B are planar cross section views each showing details of the structure of the piezoelectric type loudspeaker 101 according to the first embodiment. FIG. 2A is a bottom sectional view of the piezoelectric type loudspeaker 101 shown in FIG. 1B, taken along a line 1Y-1Y'. FIG. 2B is a bottom sectional view of the piezoelectric type loudspeaker 101 shown in FIG. 1B, taken along a line 1Z-1Z'.

Figure 3A:
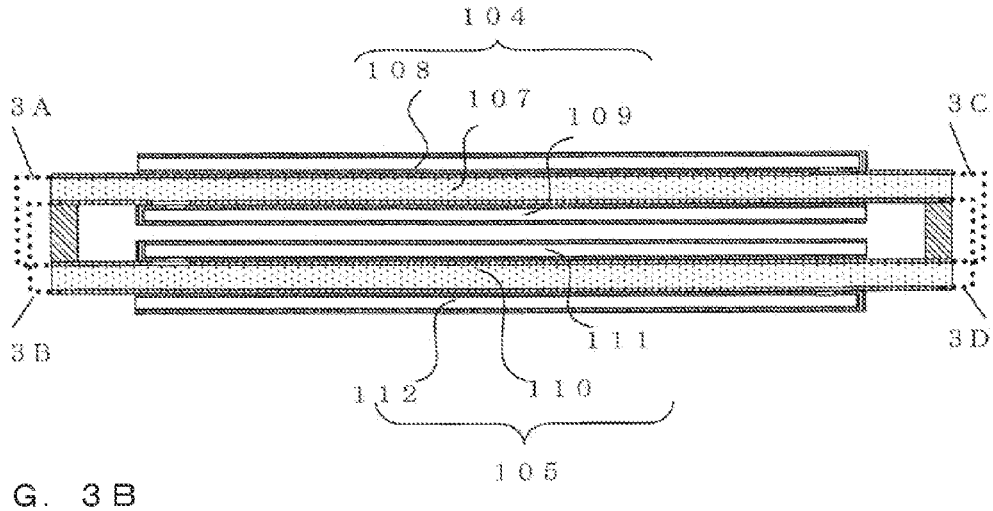
FIG. 3A is a diagram showing an electric circuit configuration of the piezoelectric type loudspeaker 101 according to the first embodiment.
Figure 3B:
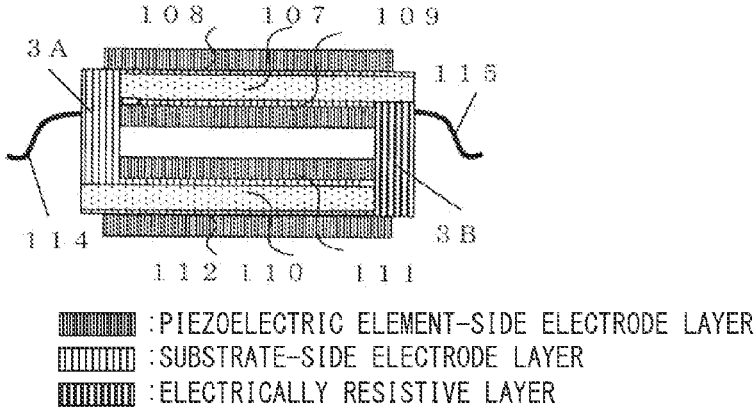
FIG. 3B is a side view of the piezoelectric type loudspeaker 101 from one surface (an electrode layer 3A, an electrically resistive layer 3B) side of FIG. 3A.
Figure 3C:
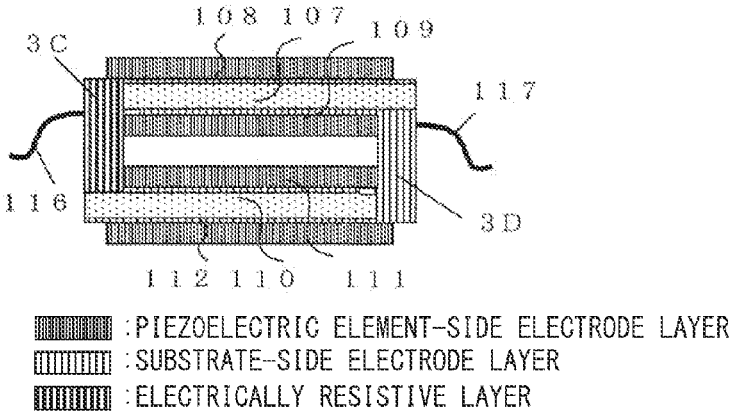
FIG. 3C is a side view of the piezoelectric type loudspeaker 101 from the other surface (an electrically resistive layer 3C, an electrode layer 3D) side of FIG. 3A.
Figure 3D:
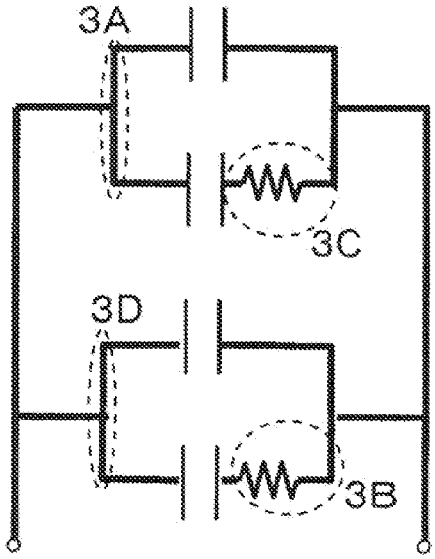
FIG. 3D is a diagram showing an electric circuit corresponding to the piezoelectric type loudspeaker 101 according to the first embodiment.

FIGS. 3A, 3B, and 3C each show details of electrode arrangements of the upper piezoelectric diaphragm 104 and the lower piezoelectric diaphragm 105, and, in order to show an electric circuit configuration of the piezoelectric type loudspeaker 101 according to the first embodiment, the edge, the housing, and the fixing member are omitted. FIG. 3A is a sectional view corresponding to the piezoelectric type loudspeaker 101 shown in FIG. 1B. FIG. 3B is a side view of the piezoelectric type loudspeaker 101 from one surface (an electrode layer 3A and an electrically resistive layer 3B) side of FIG. 3A. FIG. 3C is a side view of the piezoelectric type loudspeaker 101 from the other surface (an electrically resistive layer 3C and an electrode layer 3D) side of FIG. 3A. In FIG. 3B, the electrode layers 3A and 3D, and the electrically resistive layers 3B and 3C are formed on surfaces of the coupling members 106*a*, 106*b*, 106*c*, and 106*d*. FIG. 3D is a diagram showing an electric circuit corresponding to the piezoelectric type loudspeaker 101. In FIG. 3A, the electrode layers 3A and 3D, and the electrically resistive layers 3B and 3C are shown by dotted lines for convenience of description to illustrate an electrode connection between the upper piezoelectric diaphragm 104 and the lower piezoelectric diaphragm 105.

Figure 4A:
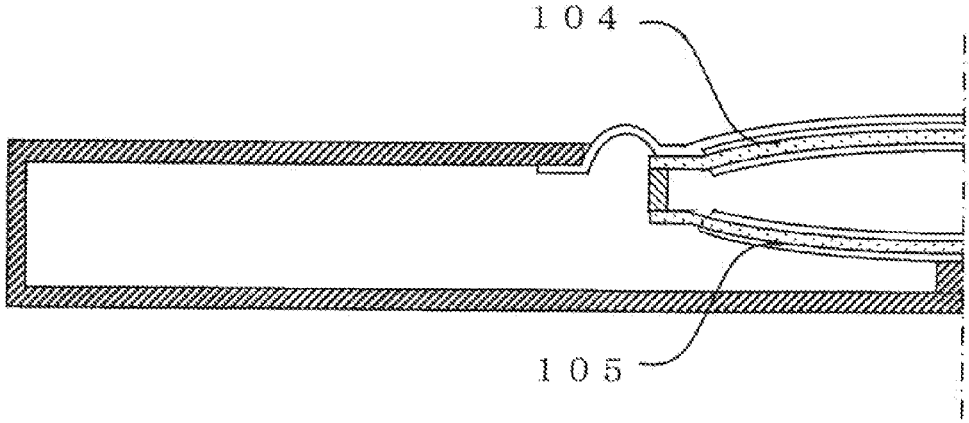
FIG. 4A is a schematic sectional view of an upper piezoelectric diaphragm 104 and a lower piezoelectric diaphragm 105 being displaced in the sound wave radiation direction in the piezoelectric type loudspeaker 101 according to the first embodiment.
Figure 4B:
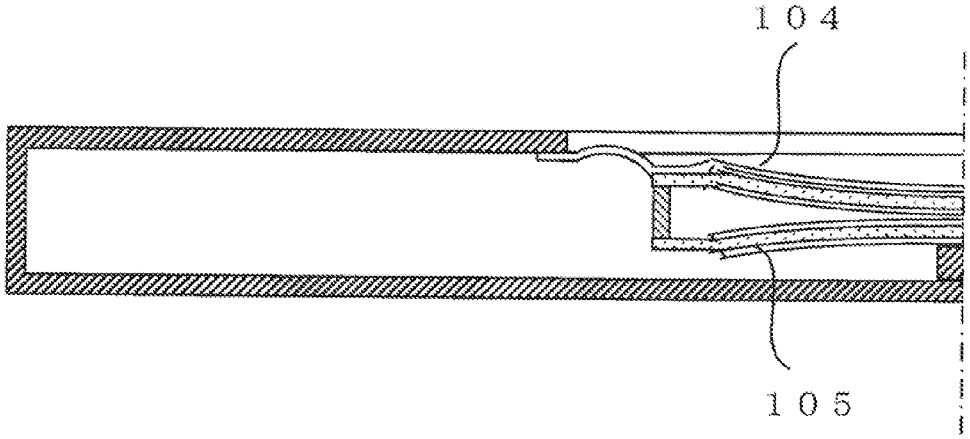
FIG. 4B is a schematic sectional view of the upper piezoelectric diaphragm 104 and the lower piezoelectric diaphragm 105 being displaced in directions opposite to the sound wave radiation direction in the piezoelectric type loudspeaker 101 according to the first embodiment.

Operations in a bass range of the piezoelectric type loudspeaker 101 having such a structure when an AC signal is applied thereto will be described using FIGS. 4A and 4B. FIG. 4A is a schematic sectional view of the upper piezoelectric diaphragm 104 and the lower piezoelectric diaphragm 105 being displaced in the sound wave radiation direction in the piezoelectric type loudspeaker 101. FIG. 4B is a schematic sectional view of the upper piezoelectric diaphragm 104 and the lower piezoelectric diaphragm 105 being displaced in opposite directions to the sound wave radiation direction in the piezoelectric type loudspeaker 101. In FIG. 4A and FIG. 4B, the right side from the center of the piezoelectric type loudspeaker 101 is omitted.

When a voltage is applied so that the piezoelectric type loudspeaker 101 is displaced in the sound wave radiation direction, the piezoelectric type loudspeaker 101 undergoes the bend deformation as shown in FIG. 4A as a whole. When a voltage is applied so that the piezoelectric type loudspeaker 101 is displaced in the direction opposite to the sound wave radiation direction, the directions of the expansion and contraction of the piezoelectric elements are reversed from those in the case as shown in FIG. 4A. As a result, the piezoelectric type loudspeaker 101 undergoes the bending deformations as shown in FIG. 4B. That is, the upper piezoelectric diaphragm 104 and the lower piezoelectric diaphragm 105 cause bending deformations in facing directions. Since the displacement of the upper piezoelectric diaphragm 104 includes displacements at end portions of the lower piezoelectric diaphragm 105 added to the displacement of the upper piezoelectric diaphragm 104 by the own bending deformation, the displacement of the upper piezoelectric diaphragm 104 can be increased more than using the upper piezoelectric diaphragm 104 alone. Therefore, according to the piezoelectric type loudspeaker 101 of the present invention, a high sound pressure can be reproduced without increasing the voltage applied to the piezoelectric elements.

Figure 5A:
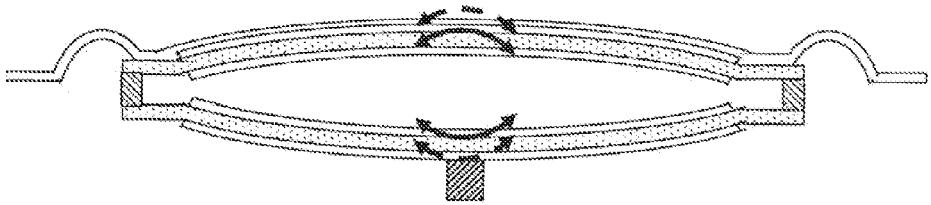
FIG. 5A is a diagram showing bending deformations at a frequency f1 in a case where the piezoelectric type loudspeaker 101 according to the first embodiment includes no electric resistance.
Figure 5B:
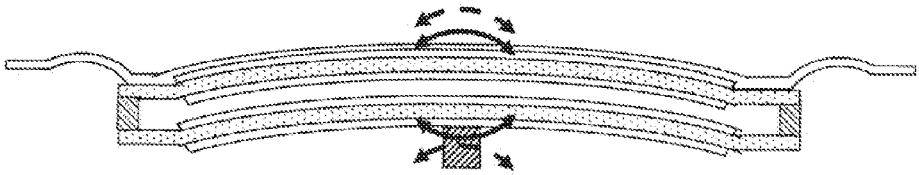
FIG. 5B is a diagram showing bending deformations at a frequency f2 in the case where the piezoelectric type loudspeaker 101 according to the first embodiment includes no electric resistance.
Figure 5C:
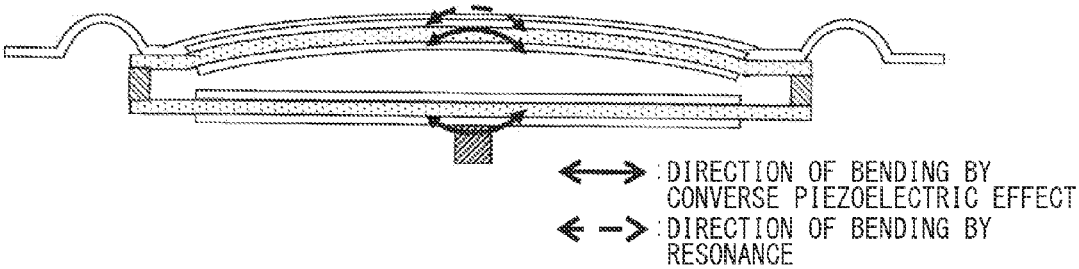
FIG. 5C is a diagram showing bending deformations at a frequency f3 in the case where the piezoelectric type loudspeaker 101 according to the first embodiment includes no electric resistance.

Also, according to the piezoelectric type loudspeaker 101 of the present invention, a problem that power efficiency is low in a high frequency band can be solved. Using FIGS. 5A, 5B, and 5C, the bending deformations of the upper piezoelectric diaphragm 104 and the lower piezoelectric diaphragm 105 in a case where the piezoelectric type loudspeaker 101 includes no electric resistance and a voltage having the same amplitude is applied to all piezoelectric elements included in the upper piezoelectric diaphragm 104 and the lower piezoelectric diaphragm 105 will be described. FIG. 5A is a sectional view showing bending deformations at a frequency f1. FIG. 5B is a sectional view showing bending deformations at a frequency f2. FIG. 5C is a sectional view showing bending deformations at a frequency f3. The conditions of such frequencies satisfies the following: f1<f2<f3.

Typically, the piezoelectric type loudspeaker 101 has a plurality of natural resonant frequencies of plates, within a reproduction frequency band. In the piezoelectric type loudspeaker 101, a direction of a bending generated force by voltage application and a direction of the bending by resonance coincide with each other on the upper piezoelectric diaphragm 104 and the lower piezoelectric diaphragm 105 near the first order natural resonant frequency as shown in FIG. 5A. Therefore, in the bass range, the upper piezoelectric diaphragm 104 and the lower piezoelectric diaphragm 105 can be displaced efficiently over the applied voltage. On the other hand, depending on positions on the upper piezoelectric diaphragm 104 and the lower piezoelectric diaphragm 105, there are portions where the directions of the bending by resonance do not coincide with the directions of the bending generated force by voltage application near natural resonant frequencies of the second order or above, as shown in FIGS. 5B and 5C. Since these natural resonances become dominant in a treble range, the effect of the bending by voltage application is cancelled by the bending by the resonance. Thus, the upper piezoelectric diaphragm 104 and the lower piezoelectric diaphragm 105 cannot be displaced efficiently.

Here, the electrically resistive layer 3C and the electrically resistive layer 3B are connected to capacitors which are realized by the piezoelectric element 111 and the piezoelectric element 112 included in the lower piezoelectric diaphragm 105. That is, the electric resistance connected in series to the piezoelectric element 111 and the piezoelectric element 112 included in the lower piezoelectric diaphragm 105 form the electric circuit of the piezoelectric type loudspeaker 101 as that shown in FIG. 3D. The electric resistance may be connected to at least one of the piezoelectric element 111 and the piezoelectric element 112 included in the lower piezoelectric diaphragm 105.

Figure 6A:
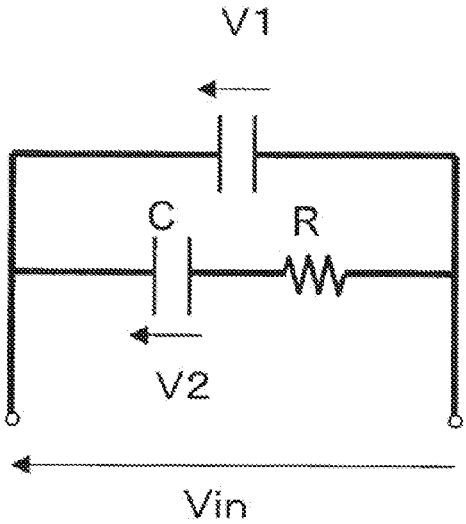
FIG. 6A is a diagram showing a simplified version of an electric circuit corresponding to the piezoelectric type loudspeaker 101 according to the first embodiment.

An electric circuit shown in FIG. 6A is a simplified version of the electric circuit shown in FIG. 3D. Provided that a capacitive component and resistive component of the circuit, which is formed by the piezoelectric elements 111 and 112 included in the lower piezoelectric diaphragm 105 and the electrically resistive layers 3C and 3D, are C and R, respectively. In such case, it is assumed that the voltage applied to the piezoelectric type loudspeaker 101 is Vin, the voltage applied to the piezoelectric elements 108 and 109 of the upper piezoelectric diaphragm 104 is V1, and the voltage applied to the piezoelectric element 111 and piezoelectric element 112 of the lower piezoelectric diaphragm 105 is V2. V1 and V2 are represented by the following equation 1 using Yin, the capacitive component C, the resistive component R, and a drive frequency f.

[Equation 1]

$$V_1 = V_{in} \qquad \text{(Equation 1)}$$

$$V_2 = \frac{1}{\sqrt{1+(2\pi fRC)^2}} V_{in} = \frac{1}{\sqrt{1+(2\pi fRC)^2}} V_1$$

That is, a driving voltage of the lower piezoelectric diaphragm 105 with respect to a driving voltage of the upper piezoelectric diaphragm 104 decreases in accordance with an increase in frequency. As a result, the upper piezoelectric diaphragm 104 that contributes to the radiation of the sound wave is mainly driven in the treble range. Therefore, unconformity between the direction of the bending by the voltage application and the direction of the bending by resonance is suppressed.

Figure 6B:
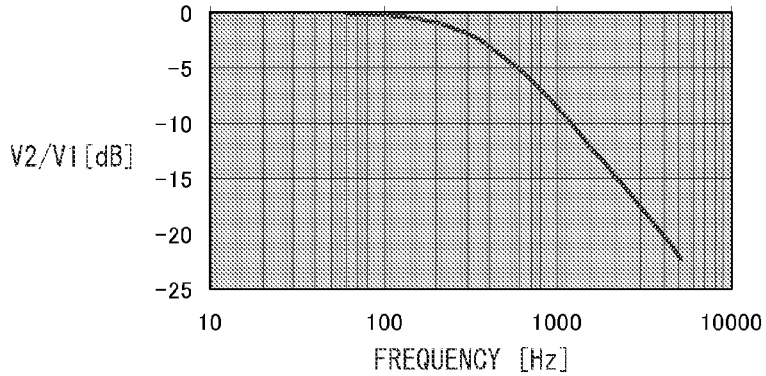
FIG. 6B is a diagram showing relationship between an applied voltage and frequency characteristics of the piezoelectric type loudspeaker 101 according to the first embodiment.

Suppose that a frequency whereby the driving voltage V2 of the lower piezoelectric diaphragm 105 becomes half with respect to the driving voltage V1 of the upper piezoelectric diaphragm 104 is fc, a value of the resistive component R may be set so that a value of CR becomes ½πfc. A graph, where a ratio of V2 with respect to V1 is taken such that the horizontal axis represents the frequency and the vertical axis represents $CR=4\times10^{-4}$, is shown in FIG. 6B by way of example. Here, the value of the resistive component R may be set aiming at reducing the driving voltage V2 in the second order natural frequency of the piezoelectric type loudspeaker 101 to a desired level, or may be set to reduce, to a desired level, the driving voltage V2 in the lowest frequency among frequencies whereby a vibration distribution of the upper piezoelectric diaphragm 104 has both positive and negative phases with respect to a rest position.

Thus, according to the first embodiment, the voltage V2 applied to the lower piezoelectric diaphragm 105 can be reduced in accordance with the increase in frequency, without separating the wiring to each diaphragm and connecting thereto an additional filter circuit. This allows enhancement of power efficiency in the high frequency band.

While the electrically resistive layers 3B and 3C are formed on surfaces of the coupling members, the electrically resistive layers 3B and 3C may be formed inside the coupling members, and may be formed in, for example, through-hole processed portions of the coupling members made of a printed circuit board material in the first embodiment. Alternatively, the electrically resistive layers 3B and 3C may be formed as internal layers of the coupling members made of composites having internal electrode layers. Furthermore, the electrically resistive layers 3B and 3C are not necessarily formed on the coupling members if the circuit shown in FIG. 6A can be realized without provision of additional filters on an external signal source side. Also, the electric resistance may be connected, not only to the piezoelectric element 111 or the piezoelectric element 112 included in the lower piezoelectric diaphragm 105, but also to at least one of the piezoelectric element 108 and the piezoelectric element 109 included in the upper piezoelectric diaphragm 104.

Second Embodiment

A piezoelectric type loudspeaker 201 according to a second embodiment has characteristics in that the electric resistances are provided on a substrate surface at a fixing portion of the lower piezoelectric diaphragm in the first embodiment. Hereinafter, description centered on the characteristics will be given, and those in common with the piezoelectric type loudspeaker 101 according to the first embodiment are basically omitted.

Figure 7A:
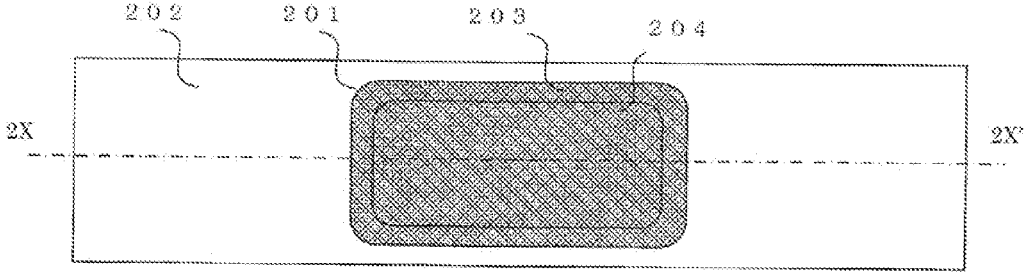
FIG. 7A is a top view of a piezoelectric type loudspeaker 201 according to a second embodiment.
Figure 7B:
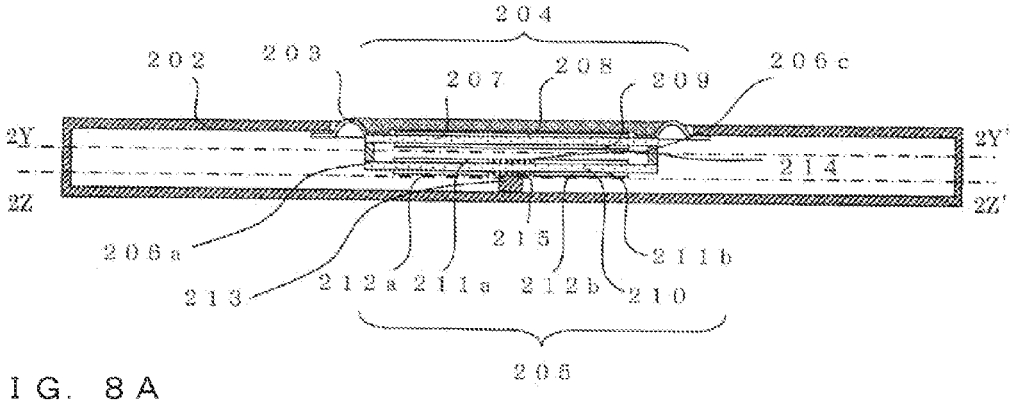
FIG. 7B is a sectional view taken from a plane parallel to a sound wave radiation direction in the piezoelectric type loudspeaker 201 of FIG. 7A.

Referring to FIGS. 7A and 7B, a structure of the piezoelectric type loudspeaker 201 according to the second embodiment will be described. FIG. 7A is a top view of the piezoelectric type loudspeaker 201 according to the second embodiment. FIG. 7B is a sectional view taken from a plane parallel to a sound wave radiation direction in the piezoelectric type loudspeaker 201 shown in FIG. 7A. FIG. 7B shows a sectional view of FIG. 7A taken along a line 2X-2X'. In FIG. 7B, the piezoelectric type loudspeaker 201 mainly includes a housing 202, an upper piezoelectric diaphragm 204, a lower piezoelectric diaphragm 205, coupling members 206*a*, 206*b*, 206*c*, and 206*d*, and an edge 203.

The upper piezoelectric diaphragm 204 includes a substrate 207, a piezoelectric element 208 mounted on an upper surface of the substrate 207, and a piezoelectric element 209 mounted on a lower surface of the substrate 207. The lower piezoelectric diaphragm 205 includes a substrate 210, piezoelectric elements 211*a* and 211*b* mounted on an upper surface of the substrate 210, and piezoelectric elements 212*a* and 212*b* mounted on a lower surface of the substrate 210. That is, the lower piezoelectric diaphragm 205 includes four piezoelectric elements 211*a*, 211*b*, 212*a*, and 212*b*, and is disposed so as to make room on the substrate surface at the fixing portion where making contact with the fixing member 213. Electrically resistive layers 214 and 215 are formed on both surfaces of the fixing portion, respectively.

Figure 8A:
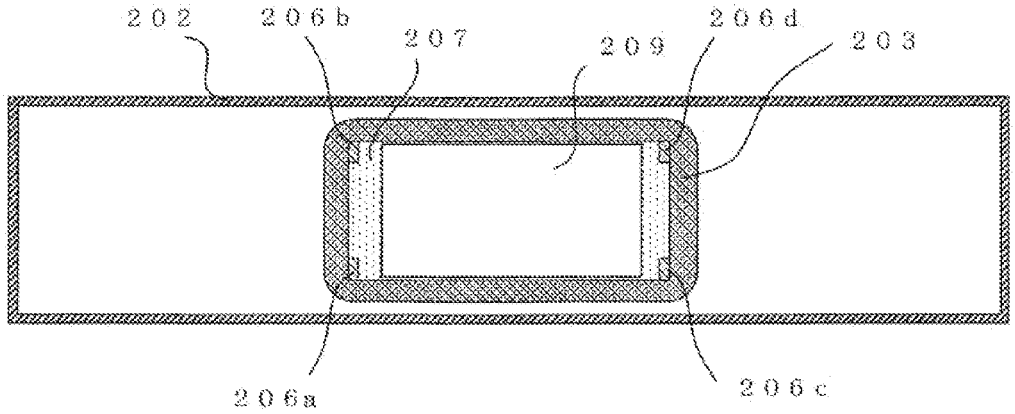
FIG. 8A is a bottom sectional view of the piezoelectric type loudspeaker 201 according to the second embodiment, taken along a line 2Y-2Y'.
Figure 8B:
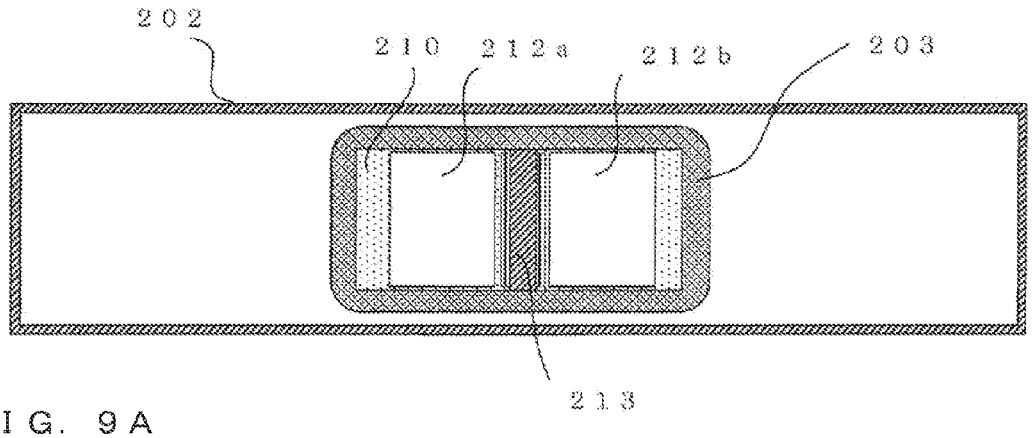
FIG. 8B is a bottom sectional view of the piezoelectric type loudspeaker 201 shown in FIG. 7B, taken along a line 2Z-2Z'.

Also, FIGS. 8A and 8B are each a planar cross section view of the piezoelectric type loudspeaker 201 according to the second embodiment. FIG. 8A is a bottom sectional view of the piezoelectric type loudspeaker 201 shown in FIG. 7B, taken along a line 2Y-2Y'. FIG. 8B is a bottom sectional view of the piezoelectric type loudspeaker 201 shown in FIG. 7B, taken along a line 2Z-2Z'.

Figure 9A:
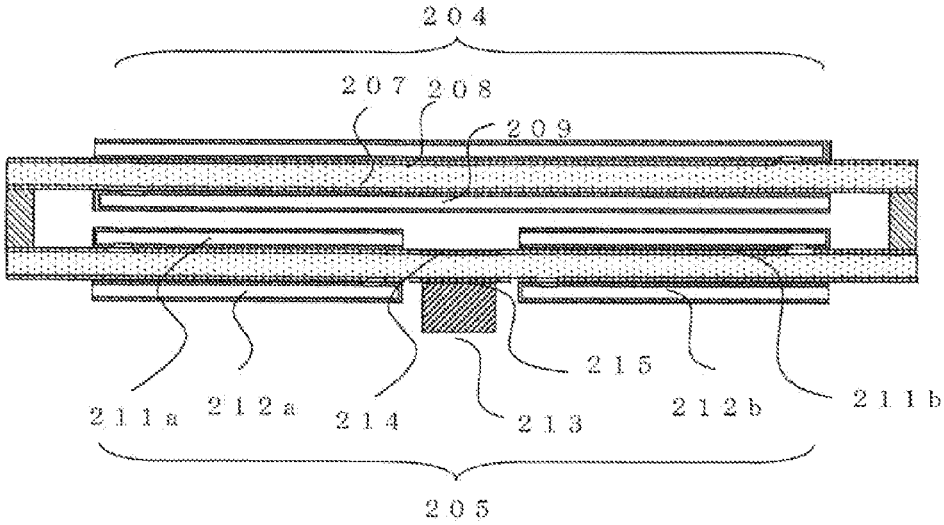
FIG. 9A is a diagram showing details of electrode arrangements of an upper piezoelectric diaphragm 204 and lower piezoelectric diaphragm 205 of the piezoelectric type loudspeaker 201 according to the second embodiment.
Figure 9B:
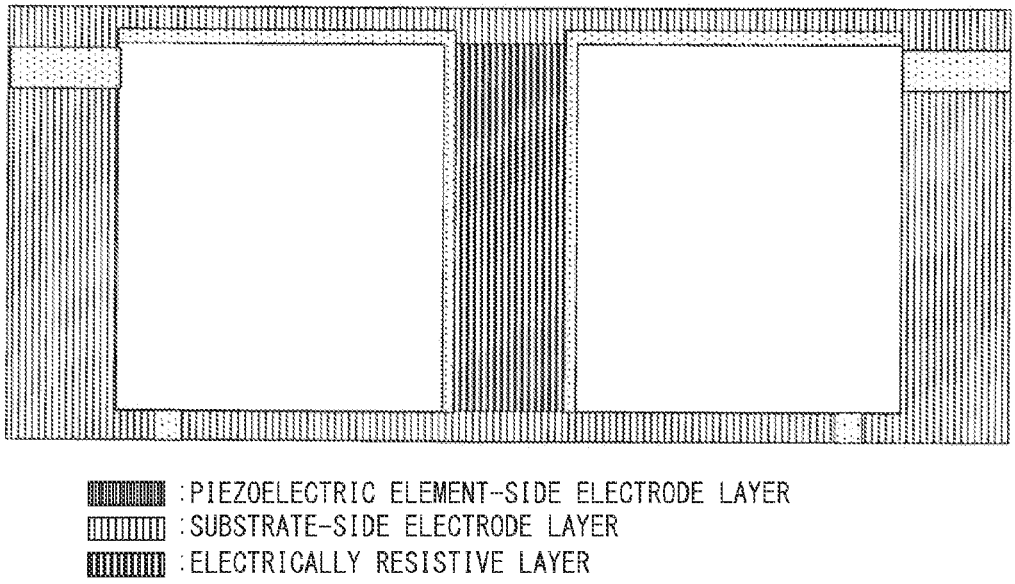
FIG. 9B is a diagram showing the arrangement of electrodes on an upper surface of the lower piezoelectric diaphragm 205.

FIG. 9A is a diagram showing electrode arrangements of the upper piezoelectric diaphragm 204 and the lower piezoelectric diaphragm 205, and, in order to show an electric circuit configuration of the piezoelectric type loudspeaker 201 according to the second embodiment, the edge, the housing, and the fixing portion are omitted. FIG. 9B is a diagram showing arrangement of electrodes on an upper surface of the lower piezoelectric diaphragm 205.

Figure 10:
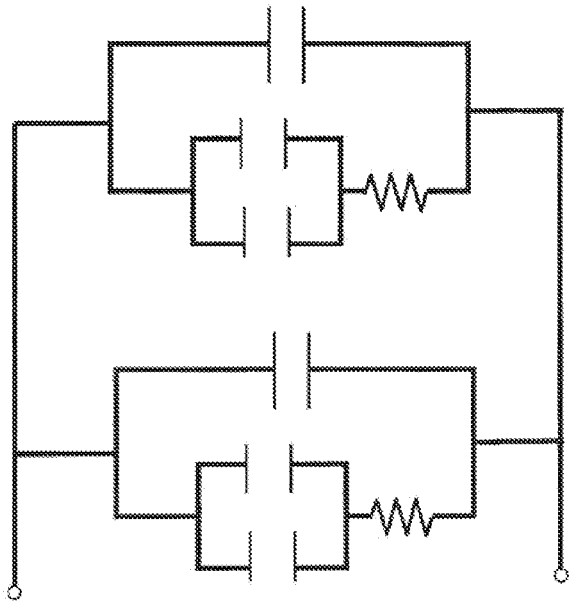
FIG. 10 is an electric circuit diagram of the piezoelectric type loudspeaker 201 according to the second embodiment.

Such electrode arrangements described above forms an electric circuit corresponding to the piezoelectric type loudspeaker 201 as an electric circuit shown in FIG. 10. The same electric circuit as that shown in FIG. 6A is a simplified version of the electric circuit shown in FIG. 10. Therefore, operations in the bass range and in the treble range of the piezoelectric type loudspeaker 201 are in common with those of the piezoelectric type loudspeaker 101 according to the first embodiment. Therefore, as with the first embodiment, even according to the second embodiment, a voltage applied to the lower piezoelectric diaphragm 205 can be reduced in accordance with an increase in frequency without separating the wiring to each diaphragm and connecting thereto an additional filter circuit. This allows enhancement of power efficiency in a high frequency band.

Also, according to the second embodiment, since the piezoelectric elements are not provided near the fixing portion of the lower piezoelectric diaphragm 205, an electrode area for a capacitor component is reduced, thereby reducing electrostatic capacity. Since the piezoelectric elements on a fixing portion side of the lower piezoelectric diaphragm 105 does not contribute to the bending deformations in the first embodiment, the same operations as those of the first embodiment can be obtained, according to the second embodiment, by using less current. Therefore, the power efficiency can be further enhanced even in a low frequency band. Furthermore, stress rupture of the piezoelectric elements due to a large bending deformation near the fixing portion can be prevented and an operable input voltage range can be expanded.

Third Embodiment

A piezoelectric type loudspeaker 301 according to a third embodiment has characteristics in that the lower piezoelectric diaphragm is not disposed facing the upper piezoelectric diaphragm, but disposed being shifted in a thickness direction from an extension plane of the upper piezoelectric diaphragm in the first embodiment. Hereinafter, description centered on the characteristics will be given, and those in common with the piezoelectric type loudspeaker 101 according to the first embodiment are basically omitted.

Figure 11A:
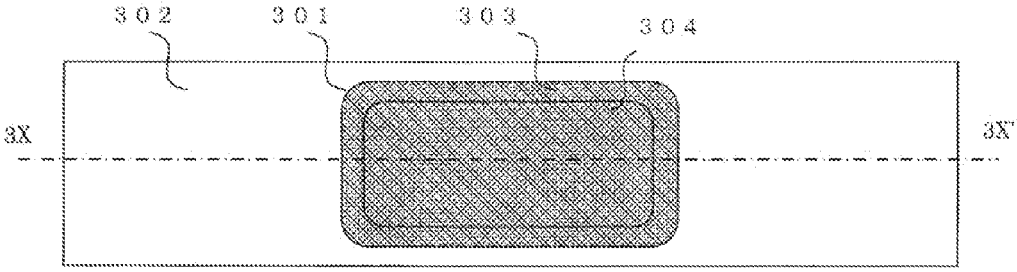
FIG. 11A is a top view of a piezoelectric type loudspeaker 301 according to a third embodiment.
Figure 11B:
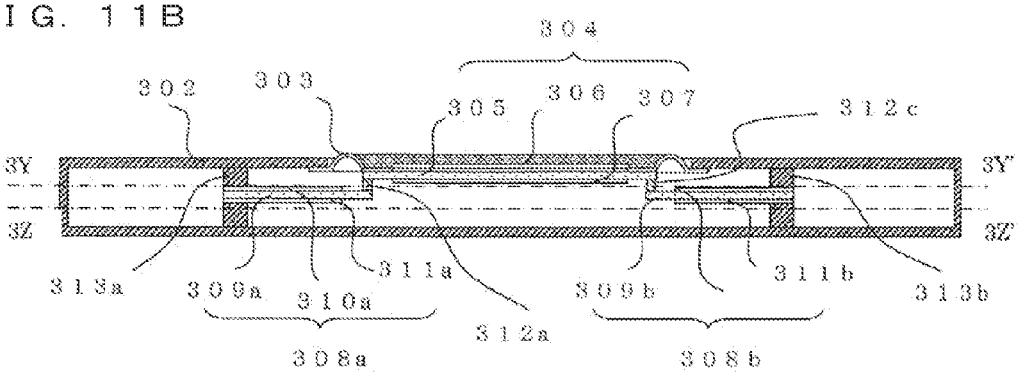
FIG. 11B is a sectional view taken from a plane parallel to a sound wave radiation direction in the piezoelectric type loudspeaker 301 according to the third embodiment.

Referring to FIGS. 11A and 11B, a structure of the piezoelectric type loudspeaker according to the third embodiment will be described. FIG. 11A is a top view of the piezoelectric type loudspeaker 301 according to the third embodiment. FIG. 11B is a sectional view taken from a plane parallel to a sound wave radiation direction in the piezoelectric type loudspeaker 301 according to the third embodiment. In FIG. 11A, of components of a housing 302 and the piezoelectric type loudspeaker 301, an upper surface of a region 304 is shown. FIG. 11B shows a sectional view of FIG. 11A taken along a line 3X-3X'. In FIG. 11B, the piezoelectric type loudspeaker 301 mainly includes the upper piezoelectric diaphragm 304, a lower piezoelectric diaphragm 308*a*, a lower piezoelectric diaphragm 308*b*, coupling members 312*a*, 312*b*, 312*c*, and 312*d*, and an edge 303. The piezoelectric type loudspeaker 301 has a left-right symmetric structure about a centerline (not shown) of FIG. 11B.

A left end portion of a lower surface of the upper piezoelectric diaphragm 304 and a right end portion of an upper surface of the lower piezoelectric diaphragm 308*a* are connected to each other via the coupling members 312*a* and 312*b*. Likewise, a right end portion of the lower surface of the upper piezoelectric diaphragm 304 and a left end portion of the upper surface of the lower piezoelectric diaphragm 308*b* are connected to each other via the coupling members 312*c* and 312*d*. The left end portion of the lower piezoelectric diaphragm 308*a* is connected to front and rear surfaces of the housing 302 via the fixing member 313*a*. The right end portion of the lower piezoelectric diaphragm 308*b* is connected to the front and rear surfaces of the housing 302 via a fixing member 313*b*.

Figure 12A:
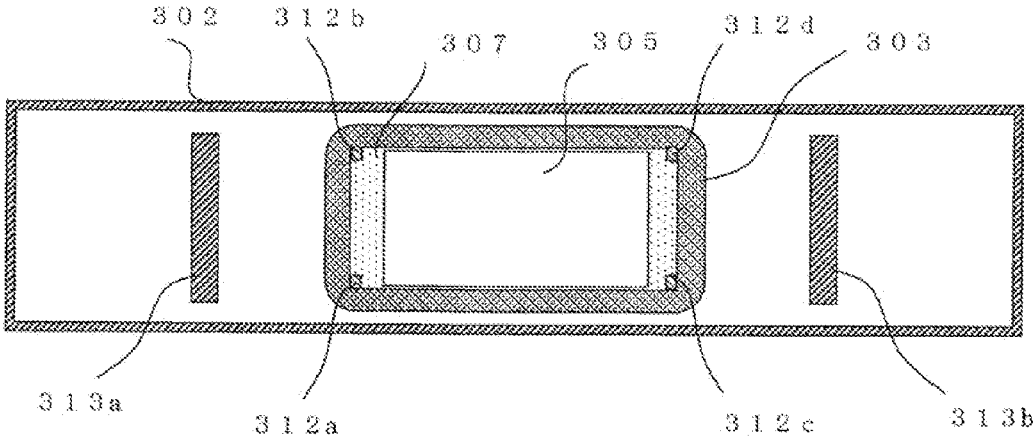
FIG. 12A is a planar cross section view of the piezoelectric type loudspeaker 301 according to the third embodiment, taken along a line 3Y-3Y'.
Figure 12B:
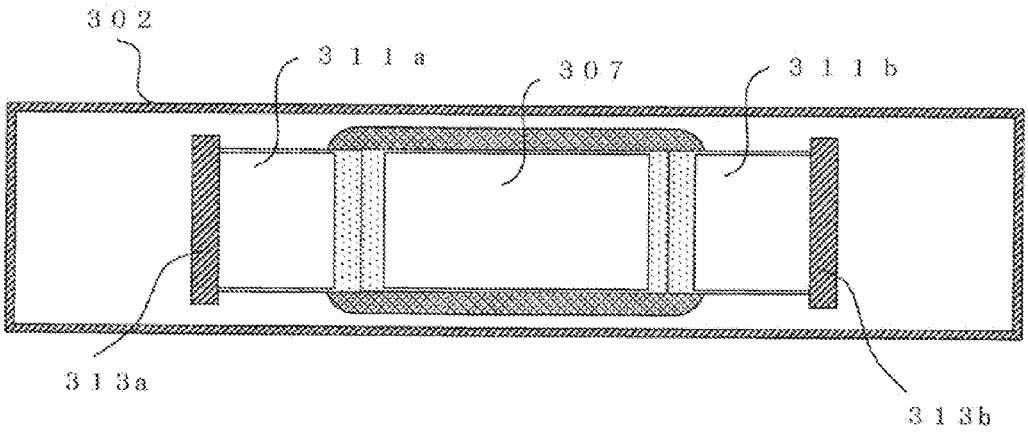
FIG. 12B is a sectional view of the piezoelectric type loudspeaker 301 shown in FIG. 11B, taken along a line 3Z-3Z'.

FIGS. 12A and 12B are each a planar cross section view showing details of the structure of the piezoelectric type loudspeaker 301 according to the third embodiment. FIG. 12A is a sectional view of the piezoelectric type loudspeaker 301 shown in FIG. 11B, taken along a line 3Y-3Y'. FIG. 12B is a sectional view of the piezoelectric type loudspeaker 301 shown in FIG. 11B, taken along a line 3Z-3Z'.

Figure 13A:
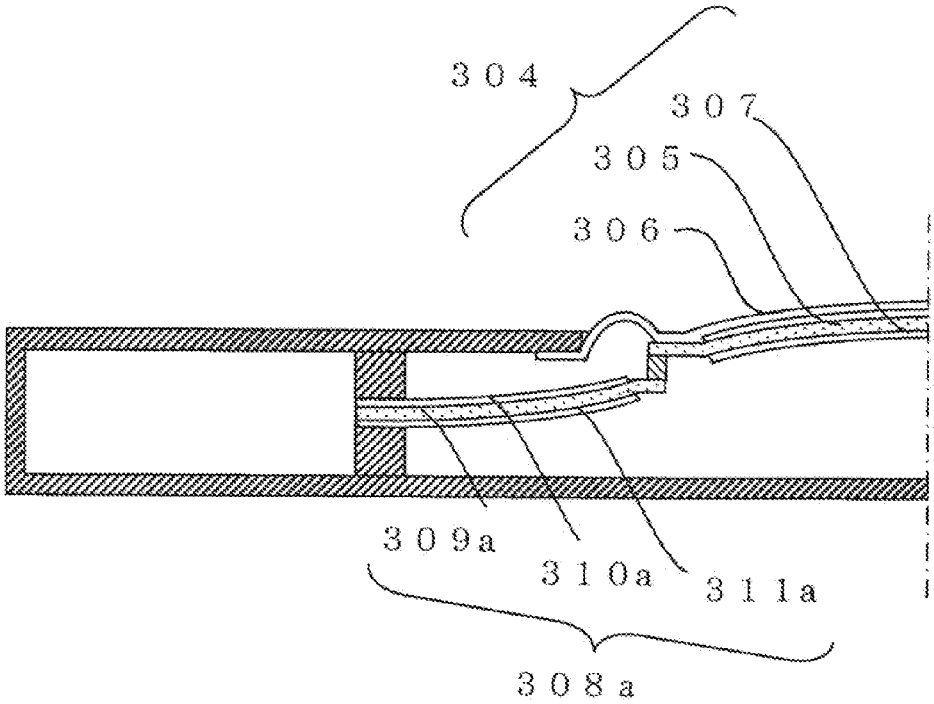
FIG. 13A is a schematic sectional view of the piezoelectric type loudspeaker 301 according to the third embodiment being displaced to a largest extent in the sound wave radiation direction.
Figure 13B:
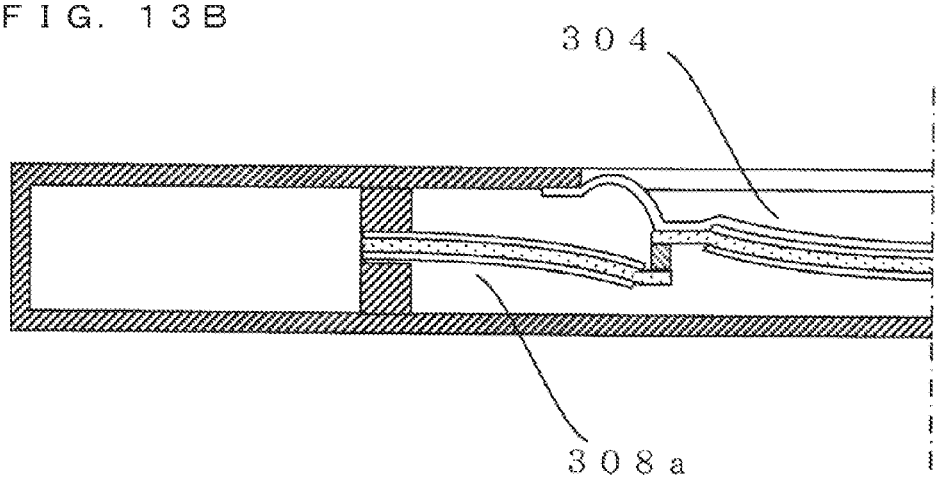
FIG. 13B is a schematic sectional view of the piezoelectric type loudspeaker 301 according to the third embodiment being displaced to a largest extent in a direction opposite to the sound wave radiation direction.

Operations of the piezoelectric type loudspeaker 301 having such a structure when the voltage is applied thereto will be described using FIGS. 13A and 13B. FIG. 13A is a schematic sectional view of the piezoelectric type loudspeaker 301 being displaced to a largest extent in the sound wave radiation direction. FIG. 13B is a schematic sectional view of the piezoelectric type loudspeaker 301 being displaced to a largest extent in a direction opposite to the sound wave radiation direction. In FIGS. 13A and 13B, the right side from the center of the piezoelectric type loudspeaker 301 is omitted.

When a voltage is applied so that the piezoelectric type loudspeaker 301 is displaced in the sound wave radiation direction, the piezoelectric element 306 and the piezoelectric element 311*a* deform expanding in a main surface direction, the piezoelectric element 307 and the piezoelectric element 310*a* deform contracting in the main surface direction, and the substrate 305 and the substrate 309*a* do not expand or contract. As a result, the piezoelectric type loudspeaker 301 undergoes a bending deformation as shown in FIG. 13A as a whole. When the voltage is applied so that the piezoelectric type loudspeaker 301 is displaced in the direction opposite to the sound wave radiation direction, the expansion and contraction of the piezoelectric elements is reversed from that in the case shown in FIG. 13A. As a result, the piezoelectric type loudspeaker 301 undergoes a bending deformation as shown in FIG. 13B.

Here, since it is the displacement of the upper piezoelectric diaphragm 304 and the edge 303 that contribute to a sound pressure a predetermined distance above the piezoelectric type loudspeaker 301, the high sound pressure can be reproduced without increasing the voltage applied to the piezoelectric elements in the third embodiment, as with the first embodiment.

Also in the third embodiment, the connection of the electric resistance (not shown) in series to the piezoelectric elements included in the lower piezoelectric diaphragms 308*a* and 308*b* reduces the voltage applied to the lower piezoelectric diaphragms 308*a* and 308*b* in accordance with the increase in frequency without separating the wiring to each diaphragm and connecting thereto an additional filter circuit, as with the first embodiment. This allows enhancement of power efficiency in a high frequency band.

Fourth Embodiment

A piezoelectric type loudspeaker 401 according to a fourth embodiment has characteristics in that four piezoelectric diaphragms are provided so as to be disposed facing each other in the first embodiment, and each of which undergoes a bending deformation in an opposite direction relative to a main surface of the diaphragm. Hereinafter, description centered on the characteristics will be given, and those in common with the piezoelectric type loudspeaker 101 according to the first embodiment are basically omitted.

Figure 14A:
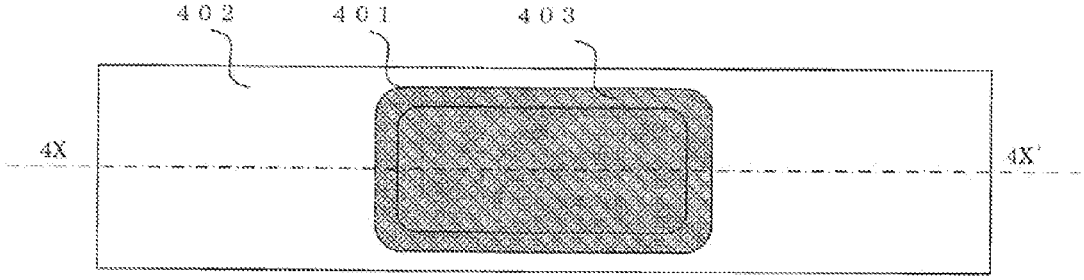
FIG. 14A is a top view of a piezoelectric type loudspeaker 401 according to a fourth embodiment.
Figure 14B:
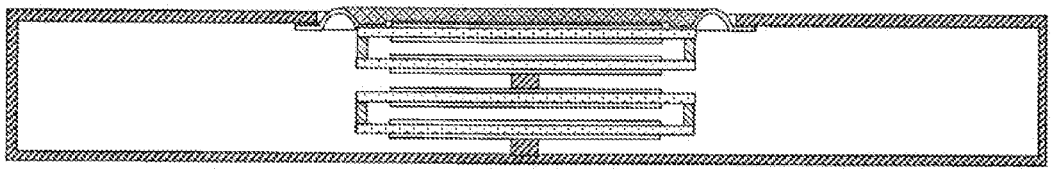
FIG. 14B is a sectional view taken from a plane parallel to the sound wave radiation direction in the piezoelectric type loudspeaker 401 according to the fourth embodiment.

Referring to FIGS. 14A and 14B, a structure of the piezoelectric type loudspeaker 401 according to the fourth embodiment will be described. FIG. 14A is a top view of the piezoelectric type loudspeaker 401 according to the fourth embodiment. FIG. 14B is a sectional view taken from a plane parallel to a sound wave radiation direction in the piezoelectric type loudspeaker 401 according to the fourth embodiment. FIG. 14B shows a sectional view of FIG. 14A taken along a line 4X-4X'. In FIG. 14B, the piezoelectric type loudspeaker 401 is realized by disposing, in a thickness direction, two sets of two piezoelectric diaphragms coupled to each other at end portions, and further coupling the two sets of piezoelectric diaphragms to each other at center portions in a long side direction.

Here, a voltage which causes the facing diaphragms to bend in opposite directions is applied to the piezoelectric type loudspeaker 401. That is, if the piezoelectric type loudspeaker 401 is given a voltage which causes the bending deformation shown in FIG. 14B to be overlapped one on the other in the thickness direction, the high sound pressure can be reproduced without increasing the voltage applied to the piezoelectric elements of the first embodiment, as with the first embodiment.

Figure 14C:
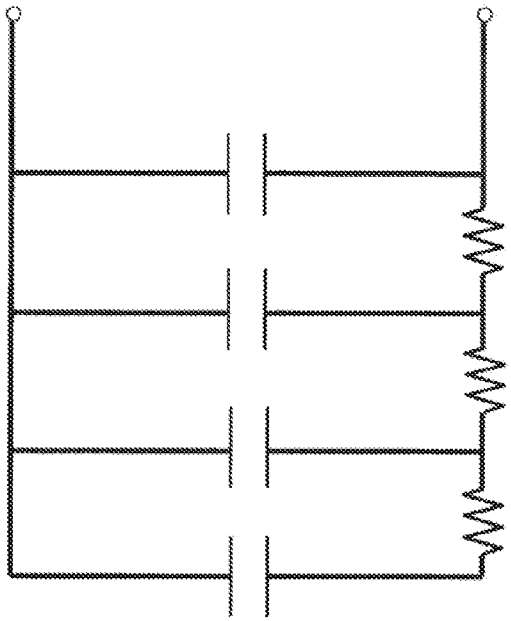
FIG. 14C is an electric circuit diagram of the piezoelectric type loudspeaker 401 according to the fourth embodiment.

Also, in the fourth embodiment, if electrically resistive layers (not shown) are formed on the coupling members in a similar fashion to the piezoelectric type loudspeaker 101 according to the first embodiment, a multi-stage filter RC circuit shown in FIG. 14C can be formed. This allows piezoelectric diaphragms closer to the fixing member side to better reduce the applied voltage in high band.

While it is assumed, in the first to fourth embodiments, that the capacitor component which forms the RC circuit is the piezoelectric element only, the capacitor component is not necessarily the piezoelectric element only. A capacitor as an electrical element may be included in addition to the piezoelectric element. For example, a multi-stage filter circuit made up of plural sets of an electric resistance and a capacitor may be formed, and at least one of the capacitors may be as a piezoelectric element, and thereby a frequency band of a signal voltage applied to the piezoelectric element may be controlled.

Fifth Embodiment

Figure 15:
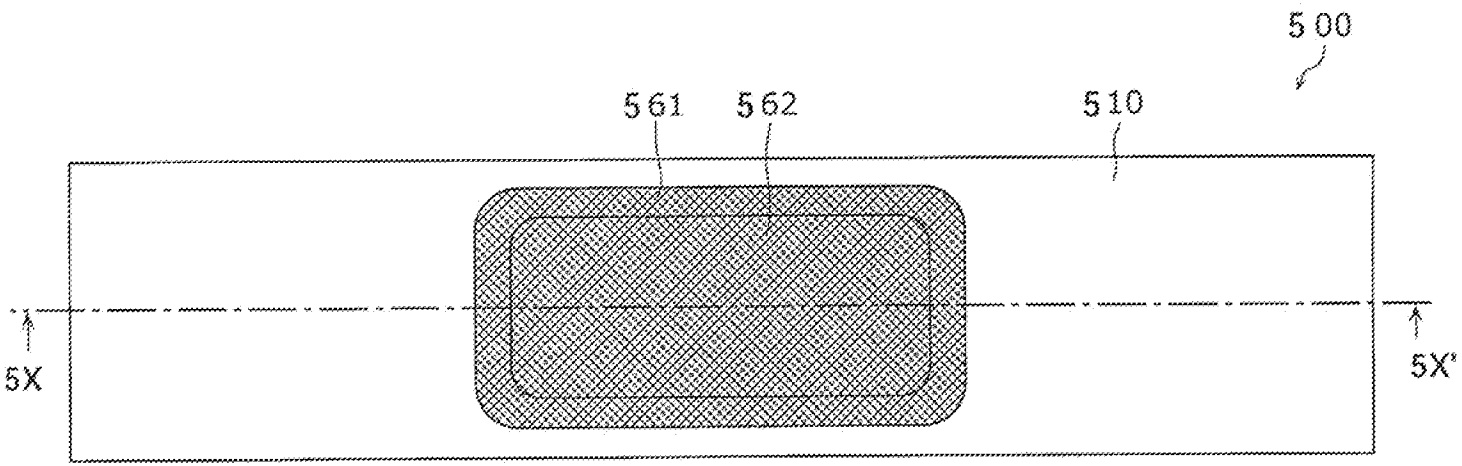
FIG. 15 is a front view of a piezoelectric type loudspeaker according to a fifth embodiment.
Figure 16:
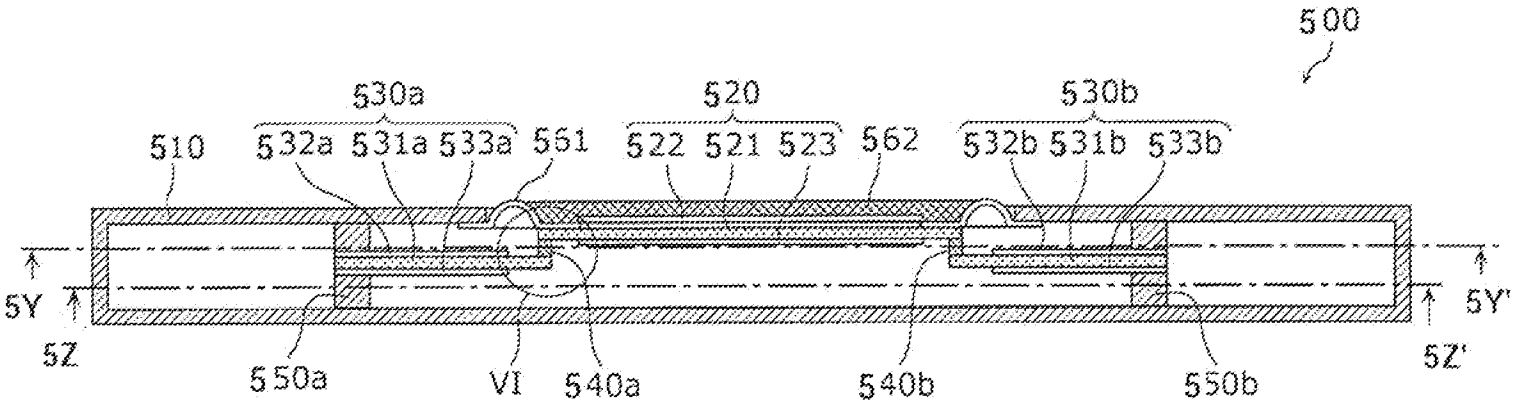
FIG. 16 is a sectional view of FIG. 15 taken along a line 5X-5X'.
Figure 17:
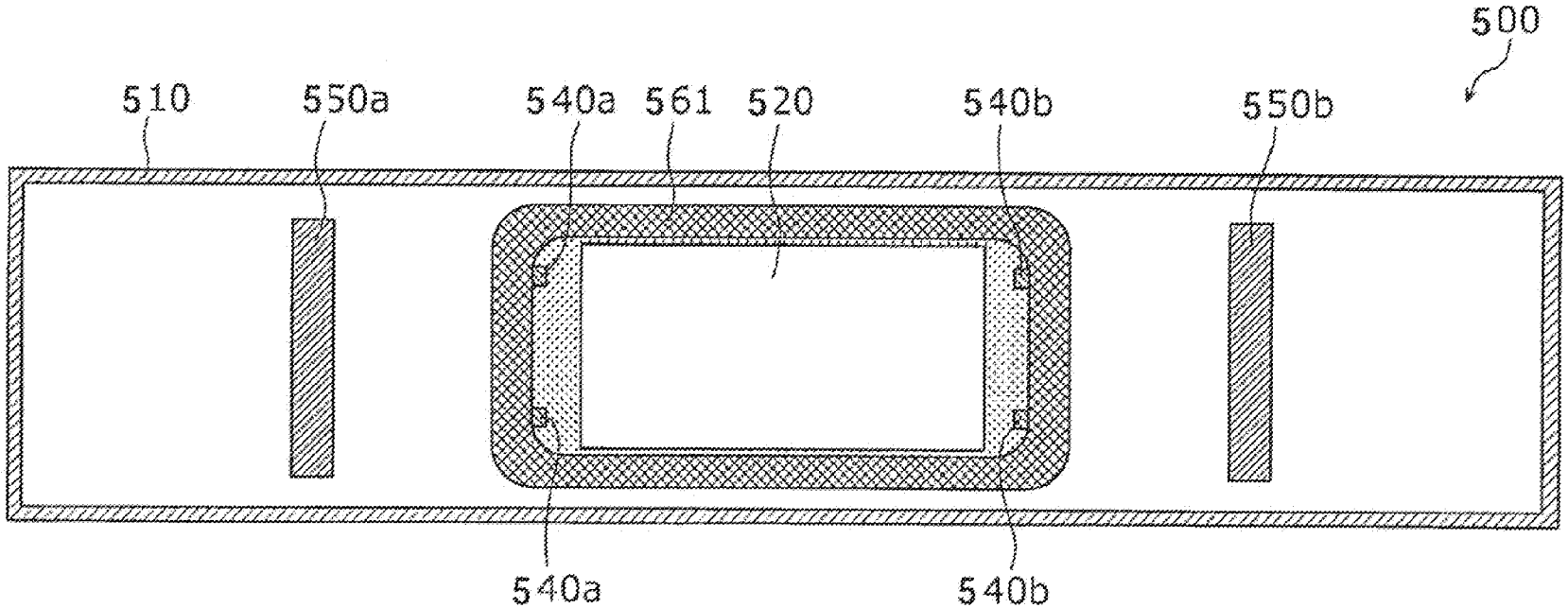
FIG. 17 is a sectional view of FIG. 16 taken along a line 5Y-5Y'.
Figure 18:
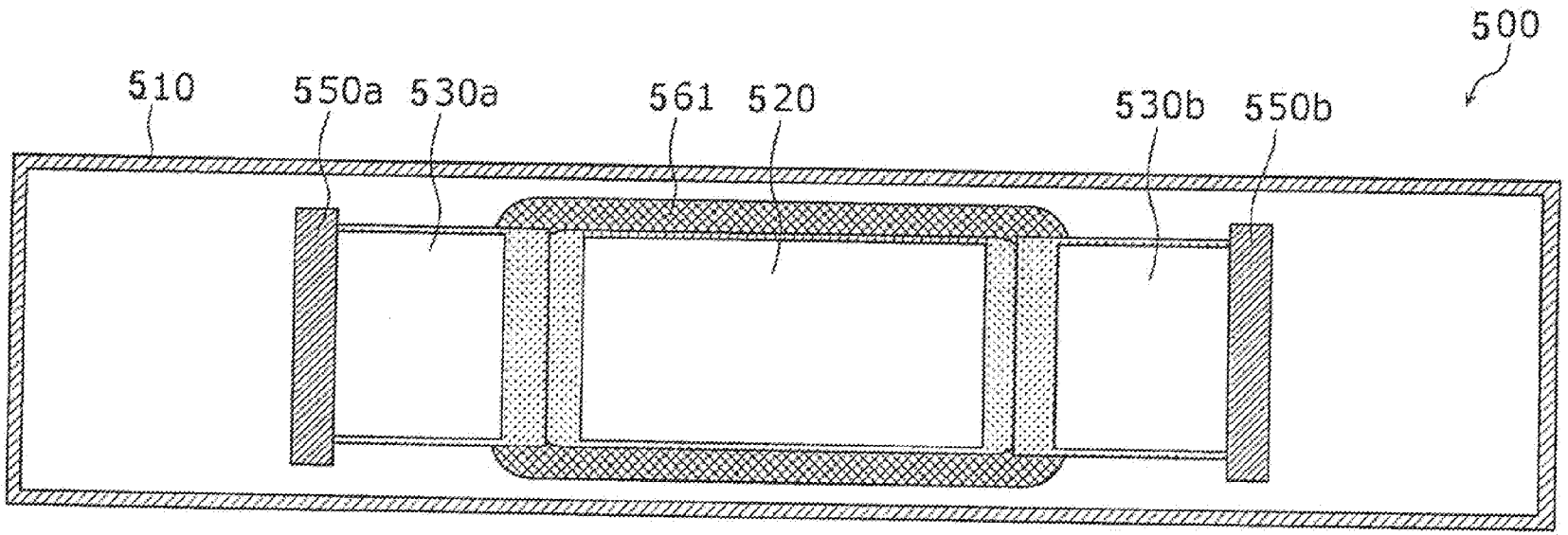
FIG. 18 is a sectional view of FIG. 16 taken along a line 5Z-5Z'.
Figure 19:
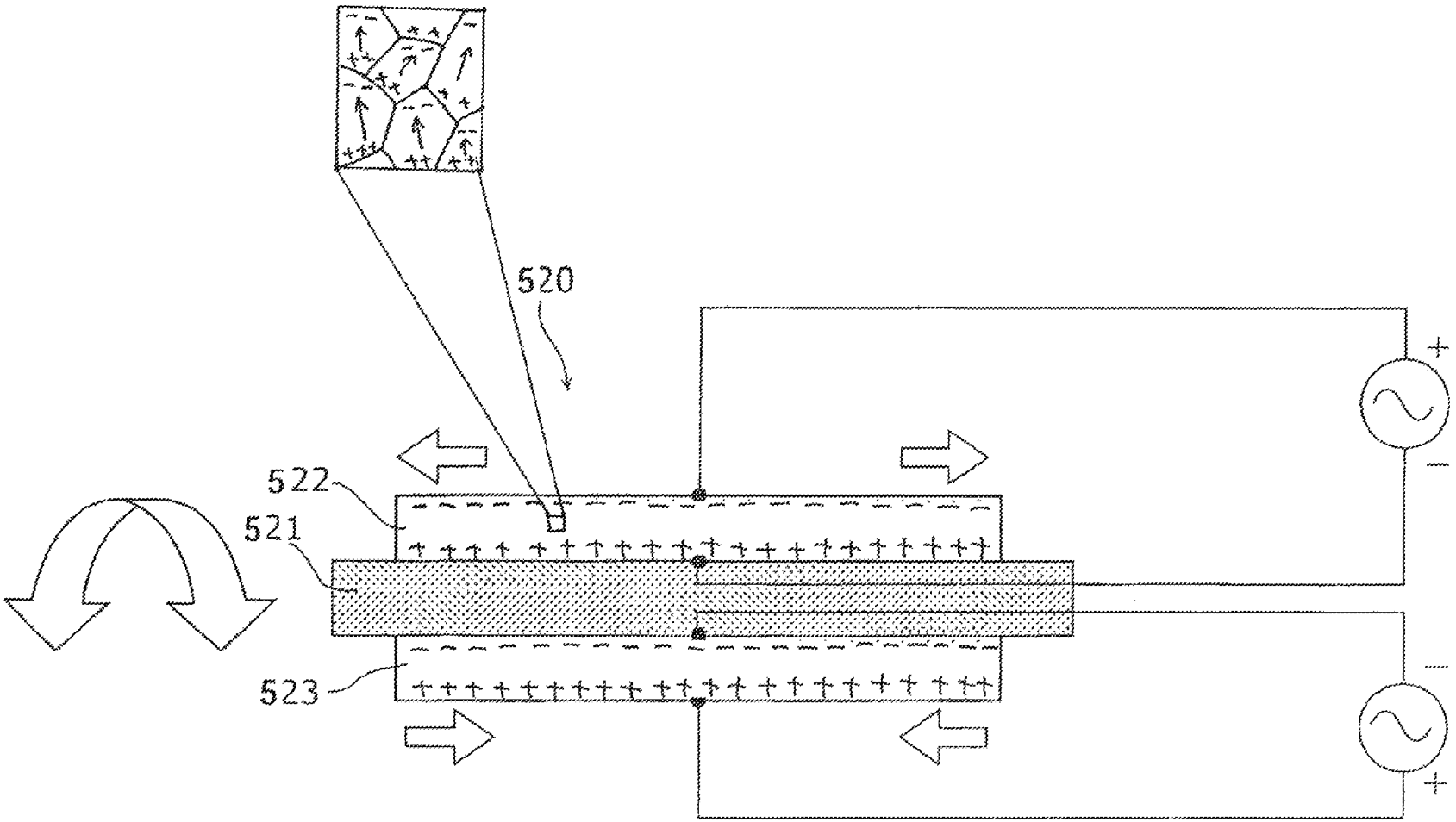
FIG. 19 is an enlarged view of a first piezoelectric diaphragm.
Figure 20:
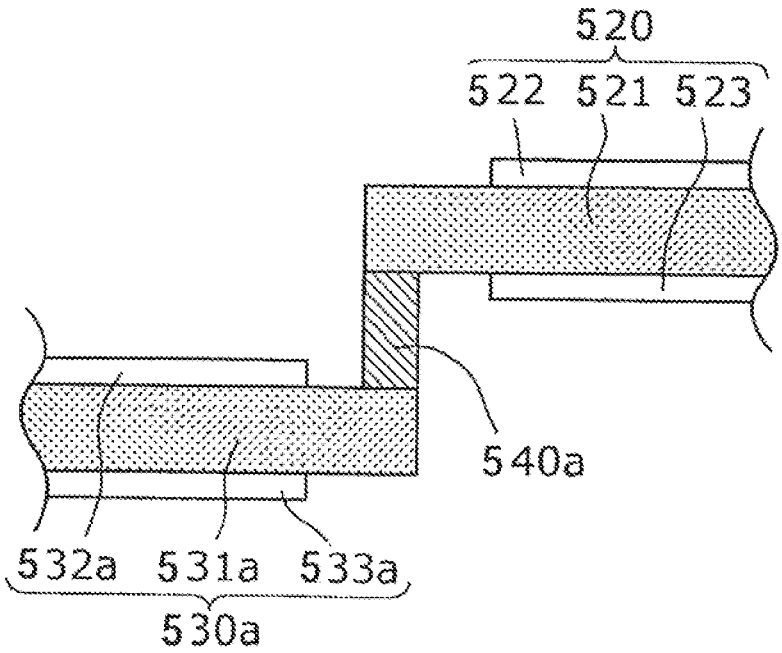
FIG. 20 is an enlarged view of a region VI shown in FIG. 16.

Referring to FIG. 15 through FIG. 20, a piezoelectric type loudspeaker 500 according to a fifth embodiment will be described. FIG. 15 is a front view of the piezoelectric type loudspeaker 500 according to the fifth embodiment. FIG. 16 is a sectional view of FIG. 15 taken along a line 5X-5X'. FIG. 17 is a sectional view of the piezoelectric type loudspeaker 500 shown in FIG. 16, taken along a line 5Y-5Y'. FIG. 18 is a sectional view of the piezoelectric type loudspeaker 500 shown in FIG. 16, taken along a line 5Z-5Z'. FIG. 19 is an enlarged view of the first piezoelectric diaphragm 520. FIG. 20 is an enlarged view of a region VI shown in FIG. 16.

As shown in FIG. 15 to FIG. 18, the piezoelectric type loudspeaker 500 according to the fifth embodiment mainly includes a housing 510, a first piezoelectric diaphragm 520, second piezoelectric diaphragms 530*a* and 530*b*, coupling members 540*a* and 540*b*, fixing members 550*a* and 550*b*, an edge 561, and a radiating plate protection film 562. The piezoelectric type loudspeaker 500 has a left-right symmetric structure about a centerline (not shown) of FIG. 16.

The housing 510 is in a substantially parallelepiped shape having space in which diaphragms (described below) are accommodated. Also, an opening is provided in a wall on a front surface side of the housing 510. Since the piezoelectric type loudspeaker 500 according to the fifth embodiment is mounted in, for example, a flat-screen television, the thickness (a dimension of the FIG. 16 in the up-down direction) is extremely small as compared to the length and width.

The first piezoelectric diaphragm 520 and the second piezoelectric diaphragms 530*a* and 530*b* are flat plate-shaped members formed of a substantially rectangular shape having long sides and short sides, and each diaphragm functions as a diaphragm which vibrates by having a voltage applied thereto. While the first piezoelectric diaphragm 520 and the second piezoelectric diaphragms 530*a* and 530*b* according to the fifth embodiment are given by way of example as bimorph type piezoelectric diaphragms each having piezoelectric elements mounted on both surfaces of the substrate, monomorph type piezoelectric diaphragms having the piezoelectric element mounted only on one surface of the substrate may be employed in the present invention.

That is, the first piezoelectric diaphragm 520 includes a substrate 521, a piezoelectric element 522 mounted on an upper surface of the substrate 521, and a piezoelectric element 523 mounted on a lower surface of the substrate 521. Likewise, the second piezoelectric diaphragms 530*a* and 530*b* include substrates 531*a* and 531*b*, piezoelectric elements 532*a* and 532*b* mounted on upper surfaces of the substrates 531*a* and 531*b*, and piezoelectric elements 533*a* and 533*b* mounted on lower surfaces of the substrates 531*a* and 531*b*, respectively.

Referring to FIG. 19, a configuration and operations of the first piezoelectric diaphragm 520 will be described. Since the following description is in common to the second piezoelectric diaphragms 530*a* and 530*b*, the description therefor is omitted. The substrate 521 is a flat plate-shaped member made of a conductive material or an insulating material. The piezoelectric elements 522 and 523 are flat plate-shaped members polarized in a direction intersecting with (orthogonal to) a main surface, and made of ceramics, for example. In the example of FIG. 19, negative charges are located on an upper surface side and positive charges are located on a lower surface side, of each of the piezoelectric elements 522 and 523, and the polarization direction is the upward direction. More specifically, the polarization direction can be made the upward direction as a whole by forming the piezoelectric element 522 so that the negative charges are located on an upper side and the positive charges are located on a lower side in each crystal as shown in the partially enlarged view of the piezoelectric element 522 shown in FIG. 19. This is the same regarding the piezoelectric element 523.

The upper and lower surfaces of each of the piezoelectric elements 522 and 523 are connected to a signal source. In the example of FIG. 19, the connection to the signal source are made so that electric potentials applied to the upper and lower surfaces become reversed from each other for each of the piezoelectric element 522 and the piezoelectric element 523. While two signal sources are shown in FIG. 19, it is understood that two piezoelectric elements 522 and 523 may be connected to one signal source.

Wirings which connect the piezoelectric elements 522 and 523 to the signal sources may be printed on the substrate 521, for example. In addition, the wirings connected to the piezoelectric elements 522 and 523 may be extended further to the second piezoelectric diaphragms 530*a* and 530*b*. That is, the wiring extending from the signal source may be extended via each of the first piezoelectric diaphragm 520 and the second piezoelectric diaphragms 530*a* and 530*b* from one side to the other side to establish continuity between the piezoelectric elements 522, 523, 532*a*, 532*b*, 533*a*, and 533*b*.

In the first piezoelectric diaphragm 520 having the above configuration, when a positive electric potential is applied to the upper surface side and a negative electric potential is applied to the lower surface side, the piezoelectric element 522 expands in a direction parallel to a main surface (referred to as "main surface direction". The same shall apply hereinafter.). On the other hand, if the negative electric potential is applied to the upper surface side and the positive electric potential is applied to the lower surface side, the piezoelectric element 523 contracts in the main surface direction. As a result, the first piezoelectric diaphragm 520 bends so that a center portion thereof protrudes upwardly as a whole. On the other hand, if a polarity of the voltage applied to the piezoelectric elements 522 and 523 is reversed, the first piezoelectric diaphragm 520 bends so that the center portion thereof protrudes downwardly. As a result, the first piezoelectric diaphragm 520 vibrates along with the frequencies of the signal sources.

Also, the first piezoelectric diaphragm 520 according to the fifth embodiment is disposed in an opening of the housing 510 so that a surface on one side faces outside the housing 510, and a surface on the other side faces inside the housing 510, and the first piezoelectric diaphragm 520 functions as a radiating plate radiating a sound wave. On the other hand, the second piezoelectric diaphragms 530*a* and 530*b* according to the fifth embodiment are accommodated within the internal space of the housing 510. The coupling members 540*a* and 540*b* couple the second piezoelectric diaphragms 530*a* and 530*b*, respectively, to the first piezoelectric diaphragm 520 in a positional relationship where the second piezoelectric diaphragms 530*a* and 530*b* are shifted in the thickness direction from the first piezoelectric diaphragm 520. Preferably, the coupling members 540*a* and 540*b* have high Young's modulus and low density to the substrates 521, 531*a* and 531*b*.

In the example of FIG. 16, the coupling member 540*a* couples a left end portion of the lower surface of the first piezoelectric diaphragm 520 with a right end portion of the upper surface of the second piezoelectric diaphragm 530*a*. Likewise, the coupling member 540*b* couples a right end portion of the lower surface of the first piezoelectric diaphragm 520 with a left end portion of the upper surface of the second piezoelectric diaphragm 530*b*. That is, in the fifth embodiment, the coupling is made to achieve a positional relationship where the first piezoelectric diaphragm 520 and the second piezoelectric diaphragm 530*a* are shifted to front and rear surface sides, respectively.

In the fifth embodiment, the first piezoelectric diaphragm 520 and the second piezoelectric diaphragms 530*a* and 530*b* are disposed so as to be shifted from each other also in the main surface direction (the right-left direction in FIG. 16) so that the first piezoelectric diaphragm 520 faces the second piezoelectric diaphragms 530*a* and 530*b* only at portions coupled thereto by the coupling members 540*a* and 540*b* and the first piezoelectric diaphragm 520 does not face the second piezoelectric diaphragms 530*a* and 530*b* at the other portions. Also, in the example of FIG. 17, the coupling members 540*a* and 540*b* are disposed at corner portions of the first piezoelectric diaphragm 520. That is, the coupling members 540*a* and 540*b* in the fifth embodiment couple the corner portions of the second piezoelectric diaphragms 530*a* and 530*b* with those of the first piezoelectric diaphragm 520.

The configuration of the coupling members is not limited to the above, and the coupling members may be, for example, members having elongated shapes (rod shapes), extending along each side of the first piezoelectric diaphragm 520 and the second piezoelectric diaphragms 530*a* and 530*b*. The sides of the first piezoelectric diaphragm 520 and second piezoelectric diaphragms 530*a* and 530*b* may be coupled to each other by such coupling members. In this case, it is preferable that short sides are coupled to each other.

Figure 21:
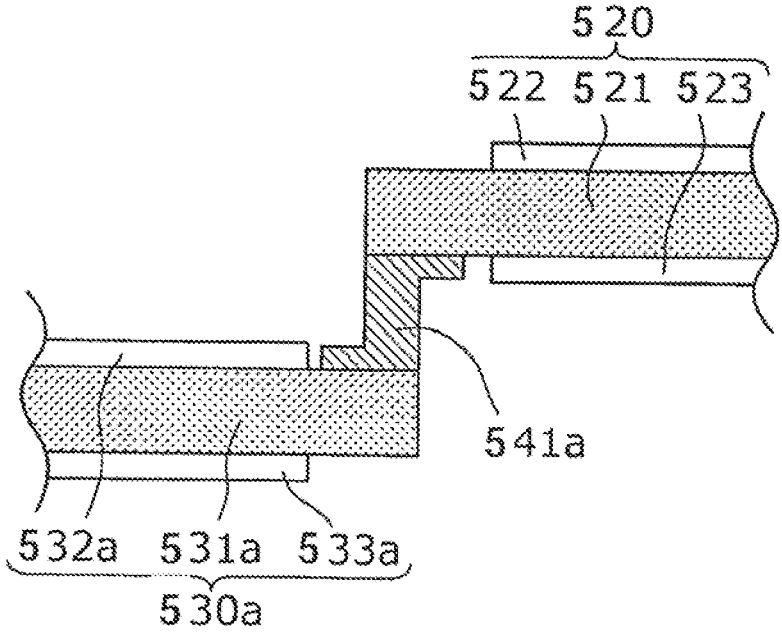
FIG. 21 is a diagram showing a first modification of a coupling member.
Figure 22:
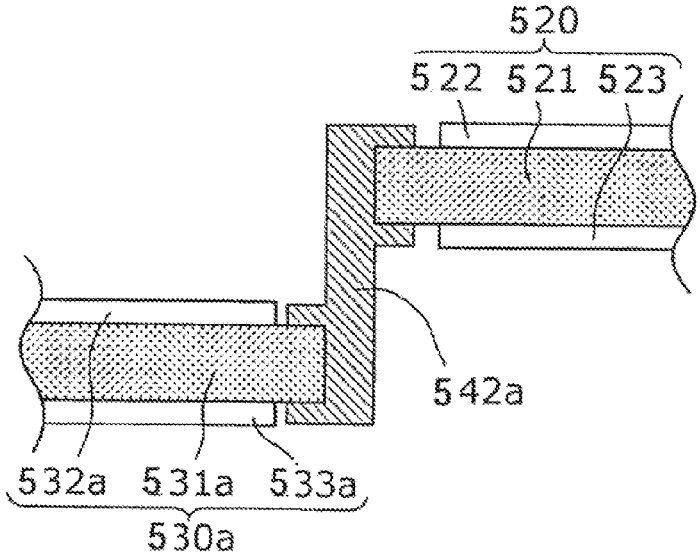
FIG. 22 is a diagram showing a second modification of the coupling member.

Referring to FIG. 20 through FIG. 22, a configuration and modification of the coupling member 540*a* will be described. Since the following description is in common to the coupling member 540*b*, description of the coupling member 540*b* is omitted. One end (upper end) of the coupling member 540*a* is attached to a lower surface of the substrate 521 of the first piezoelectric diaphragm 520 at a portion upon which the piezoelectric element 523 is not mounted. In addition, the other end (lower end) of the coupling member 540*b* is attached to an upper surface of the substrate 531*a* of the second piezoelectric diaphragms 530 at a portion upon which the piezoelectric element 532*a* is not mounted. While a specific manner of the mounting is not particularly limited, fastening means such as bolts, adhesive, or the like may be used.

Here, preferably, the coupling member 540*a* is configured so that a bending rigidity of the coupling member 540*a* in a direction intersecting with a main surface of the first piezoelectric diaphragm 520 becomes larger than a bending rigidity of the first piezoelectric diaphragm 520 and the second piezoelectric diaphragm 530*a* in the main surface direction. This allows less deformation of the coupling member 540*a*, caused by the vibration of the first piezoelectric diaphragm 520 and the second piezoelectric diaphragm 530*a*. Also, the above described wirings extending between the first piezoelectric diaphragm 520 and the second piezoelectric diaphragm 530*a* may pass through the front surface of the coupling member 540*a* or a through hole (not shown) formed inside the coupling member 540*a*.

Next, a coupling member 541*a* shown in FIG. 21 has surface areas which abut the first piezoelectric diaphragm 520 and the second piezoelectric diaphragm 530*a* and which are made larger than a sectional area of a medial portion (referring to a portion between the two abutting surfaces). This allows even lesser deformation of the coupling member 541*a*, caused by the vibration of the first piezoelectric diaphragm 520 and the second piezoelectric diaphragm 530*a*. Furthermore, the coupling member 542*a* shown in FIG. 22 includes a groove portion on a surface on one side (on the right in FIG. 22) of the upper end portion, and another groove portion on a surface on the other side (on the left in FIG. 22) of the lower end portion. The one groove portion holds the end portion of the substrate 521 of the first piezoelectric diaphragm 520 in the up and down directions, and the other groove portion holds the end portion of the substrate 531*a* of the second piezoelectric diaphragm 530*a* in the up and down directions. Such configuration also allows even lesser deformation of the coupling member 542*a*, caused by the vibration of the first piezoelectric diaphragm 520 and the second piezoelectric diaphragm 530*a*.

The fixing members 550*a* and 550*b* fix the second piezoelectric diaphragms 530*a* and 530*b*, respectively. In the fifth embodiment, the second piezoelectric diaphragms 530*a* and 530*b* are fixed to inner wall surfaces of the housing 510 by the fixing members 550*a* and 550*b*, respectively. Specifically, a left end portion of the second piezoelectric diaphragm 530*a* is fixed to the inner wall surfaces of the housing 510 on front and rear surface sides via the fixing member 550*a*. A right end portion of the second piezoelectric diaphragm 530*b* is fixed to the inner wall surfaces of the housing 510 on the front and rear surface sides via the fixing member 550*b*. Non limiting to the above configuration, however, the second piezoelectric diaphragms 530*a* and 530*b* may be fixed to the inner wall surfaces of the housing 510 on side surface sides by using the fixing members 550*a* and 550*b*, respectively.

The edge 561 functions as a sealing member which seals a gap between the opening of the housing 510 and the first piezoelectric diaphragm 520 which operates as the radiating plate. Specifically, the edge 561 is a frame along with respective shapes of the opening of the housing 510 and the first piezoelectric diaphragm 520, and an outer rim of the edge 561 is attached to a periphery of the opening of the housing 510, and an inner rim of the edge 561 is attached to a periphery of the first piezoelectric diaphragm 520. While a material which makes up the edge 561 is not particularly limited, it is preferable that the edge 561 is made of, for example, a laminate material or a pliable material such as urethane rubbers.

The radiating plate protection film 562 is disposed so as to cover a surface, facing outside the housing 510, of the first piezoelectric diaphragm 520 which operates as the radiating plate, and thereby protect the first piezoelectric diaphragm 520. While a material which makes up the radiating plate protection film 562 is not particularly limited, the same material as that of the edge 561 may be used, for example.

Figure 23:
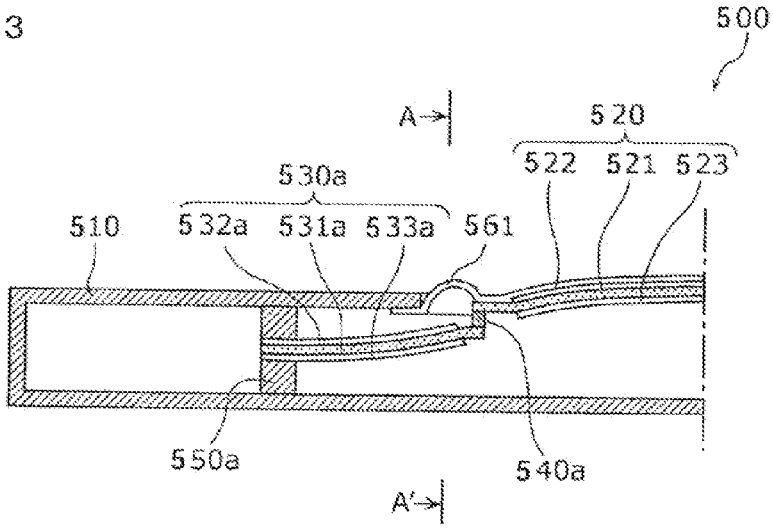
FIG. 23 is a schematic sectional view of the first piezoelectric diaphragm being displaced to a largest extent in the sound wave radiation direction.
Figure 24:
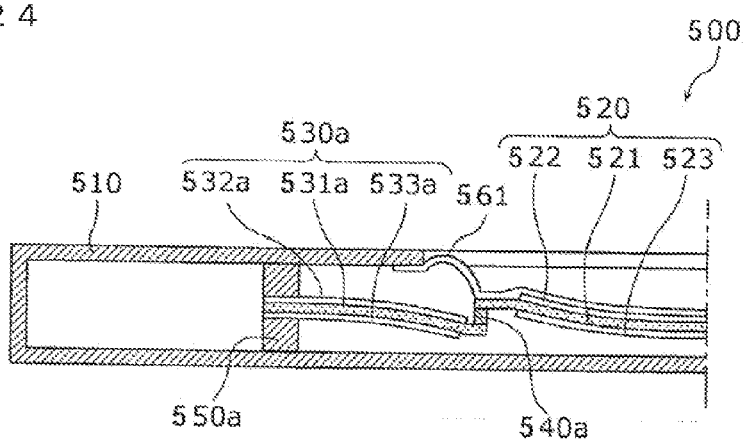
FIG. 24 is a schematic sectional view of the first piezoelectric diaphragm being displaced to a largest extent in a direction opposite to the sound wave radiation direction.

Operations of the piezoelectric type loudspeaker 500 having such a structure when the voltage is applied thereto will be described using FIG. 23 and FIG. 24. FIG. 23 is a schematic sectional view of the first piezoelectric diaphragm 520 being displaced to a largest extent in the sound wave radiation direction (the front surface side of the housing 510). FIG. 24 is a schematic sectional view of the first piezoelectric diaphragm 520 being displaced to a largest extent in a direction opposite to the sound wave radiation direction (the rear surface side of the housing 510). In FIG. 23 and FIG. 24, the right side from the center of the piezoelectric type loudspeaker 500 is omitted.

When the voltage is applied so that the first piezoelectric diaphragm 520 is displaced in the sound wave radiation direction, the piezoelectric element 522 and the piezoelectric element 533*a* deform expanding in the main surface direction, and the piezoelectric element 523 and the piezoelectric element 532*a* deform contracting in the main surface direction. On the contrary, the substrate 521 and the substrate 531*a* do not expand or contract. That is, the first piezoelectric diaphragm 520 undergoes a bending deformation so as to protrude toward the front surface side of the housing 510, and the second piezoelectric diaphragm 530*a* undergoes a bending deformation so as to protrude toward the rear surface side of the housing 510. As a result, the first piezoelectric diaphragm 520 and the second piezoelectric diaphragm 530*a* undergo the bending deformation as shown in FIG. 23 as a whole.

On the other hand, when the voltage is applied so that the first piezoelectric diaphragm 520 is displaced in the direction opposite to the sound wave radiation direction, the expansion and contraction of the piezoelectric elements 522, 523, 532*a*, and 533*a* are reversed from that in the case shown in FIG. 23. As a result, the piezoelectric type loudspeaker 500 undergoes the bending deformation as shown in FIG. 24. That is, the first piezoelectric diaphragm 520 and the second piezoelectric diaphragm 530*a* undergo reversed bending deformations from each other. Here, it is the displacements of the first piezoelectric diaphragm 520 and the edge 561 that contribute to the sound pressure of a sound radiated from the piezoelectric type loudspeaker 500. Since the left end portion of the first piezoelectric diaphragm 520 is connected to the second piezoelectric diaphragm 530*a* via the coupling member 540*a*, the displacement at each point on the first piezoelectric diaphragm 520 includes the displacement at the right end portion of the second piezoelectric diaphragm 530*a* added to the displacement by the own bending deformation of the first piezoelectric diaphragm 520. As a result, the first piezoelectric diaphragm 520, which functions as the radiating plate, vibrates at amplitude obtained by combining amplitudes of the first piezoelectric diaphragm 520 and the second piezoelectric diaphragm 530*a*, that is, amplitude larger than the individual amplitudes.

Thus, as compared to a case where the piezoelectric type loudspeaker 500 includes the first piezoelectric diaphragm 520 only, a larger displacement as a whole can be obtained without increasing the bending deformation of the first piezoelectric diaphragm 520. Because of this, according to the fifth embodiment, the high sound pressure can be reproduced without increasing the voltage applied to the piezoelectric elements 522, 523, 532*a*, and 533*a*. Also, according to the fifth embodiment, since the edge 561 made of the pliable material is disposed on a periphery of the first piezoelectric diaphragm 520 that contributes to the sound pressure, the first piezoelectric diaphragm 520 can be displaced to a large extent while preventing reduction of the sound pressure due to an opposite phase sound which is generated from the lower surface of the first piezoelectric diaphragm 520 and which comes around to the upper surface.

Also, according to the fifth embodiment, the first piezoelectric diaphragm 520 and the second piezoelectric diaphragm 530*a* are connected to each other in a direction perpendicular to the respective main surfaces via the coupling member 540*a*. Therefore, as compared to a case where the main surfaces of the first piezoelectric diaphragm 520 and the second piezoelectric diaphragm 530*a* are positioned on the same plane, a larger displacement can be obtained while preventing the displaced first piezoelectric diaphragms 520 and the displaced second piezoelectric diaphragm 530*a* from making contact with the inner wall surfaces of the housing 510 even if an internal thickness of the housing 510 is small. That is, in FIG. 23, the position of the second piezoelectric diaphragm 530*a* can be set rearward so that the piezoelectric element 532*a* does not make contact with the inner wall surface of the housing 510 on the front surface side. Likewise, in FIG. 24, the position of the first piezoelectric diaphragm 520 can be set frontward so that the piezoelectric element 523 does not make contact with the inner wall surface of the housing 510 on the rear surface side.

The height of the coupling member 540*a* for preventing the contact with the inner wall surfaces of the housing 510 as described above has an upper and lower limit values and are presented by the following Equation 2. In Equation 2, $t_{joint}$ represents the height of the coupling member 540*a*, $x_{lower}$ represents a maximum value of magnitude of displacement at the right end portion of the second piezoelectric diaphragm 530*a*, $x_{lower}'$ represents a maximum value of magnitude of displacement of the second piezoelectric diaphragm 530*a* at a position (A-A' of FIG. 23) a vertical section of which is shared with an end portion of the edge 561, $x_{upper}$ represents a maximum value of a displacement difference between the left end portion and center portion of the first piezoelectric diaphragm 520, and $t_c$ represents a distance (internal dimension) between the inner wall surface on the front surface side and the inner wall surface on the rear surface side, of the housing 510.

[Equation 2]

$$\mathrm{Max}\left(\frac{t_c + x_{lower} + x_{upper}}{2}, x'_{lower}\right) < t_{joint} < t_c - x_{lower} \quad \text{(Equation 2)}$$

where, $x_{lower}$, $x_{lower}'$, and $x_{upper}$ are values which are arbitrarily determined respectively by: an effective vibration area of the piezoelectric type loudspeaker 500; a distance between the piezoelectric type loudspeaker 500 and a sound receiving point; and a mode in a lowest order resonance frequency within the reproduction frequency band of the piezoelectric type loudspeaker 500. Also, disposition of the right end portion of the second piezoelectric diaphragm 530*a* and the left end portion of the second piezoelectric diaphragm 530*b* below the edge 561 further increases the maximum magnitude of displacement in the sound wave radiation direction.

Furthermore, according to the fifth embodiment, the first piezoelectric diaphragm 520 that contributes to the sound pressure receives is subjected to a pressure difference between the external and internal spaces of the housing 510. On the contrary, it can be regarded that the second piezoelectric diaphragms 530*a* and 530*b* accommodated inside the housing 510 are subjected to the same pressure from above and below in the internal space of the housing 510. Therefore, as compared to conventional loudspeakers in which the entirety of the diaphragm is subjected to an effect of the stiffness of the air on the rear surface of the housing 510, the bass range is easy to reproduce even with a housing having a small volume.

Sixth Embodiment

Figure 25:
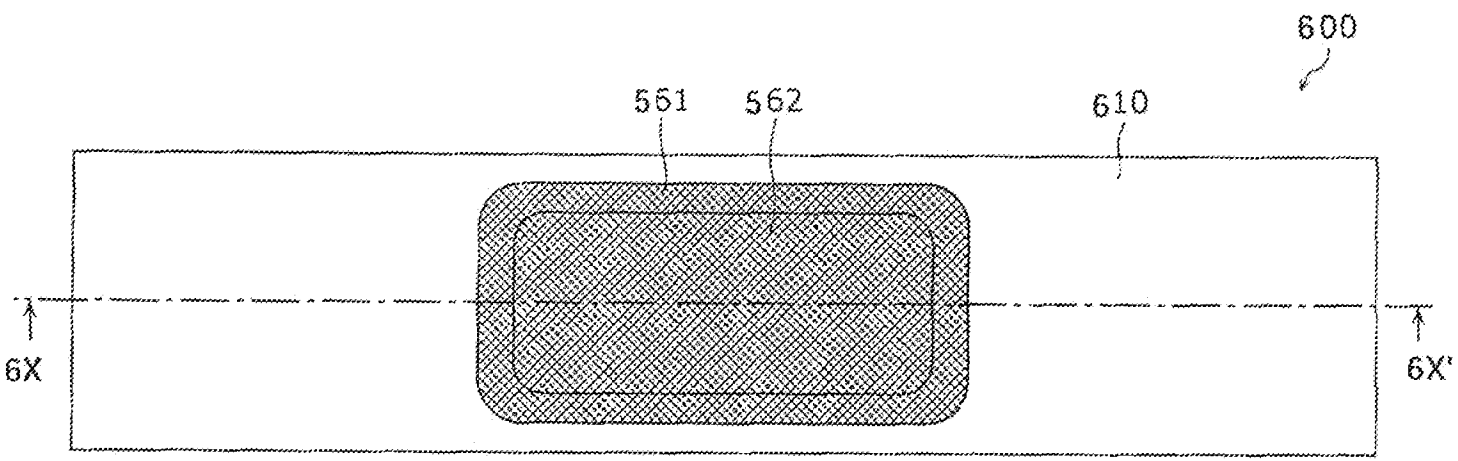
FIG. 25 is a plan view of a piezoelectric type loudspeaker according to a sixth embodiment.
Figure 26:
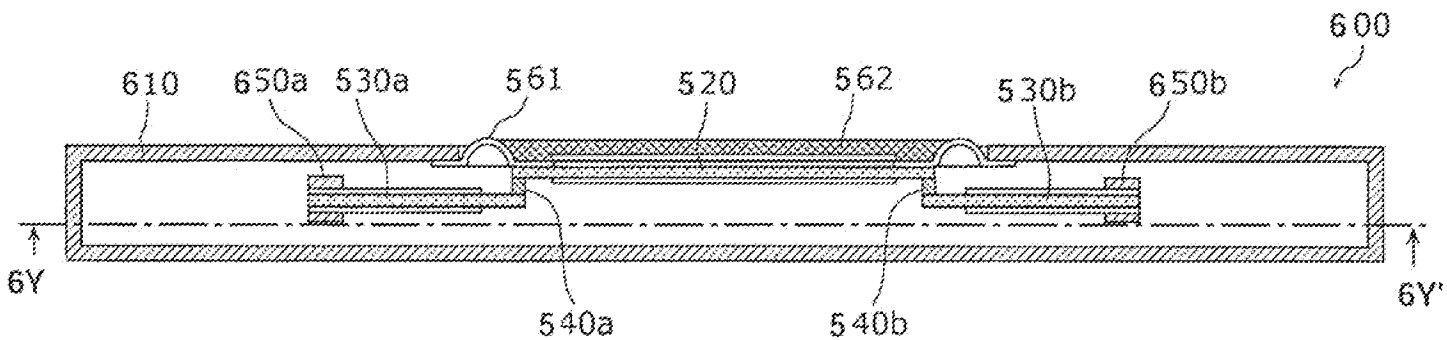
FIG. 26 is a sectional view of FIG. 25 taken along a line 6X-6X'.
Figure 27:
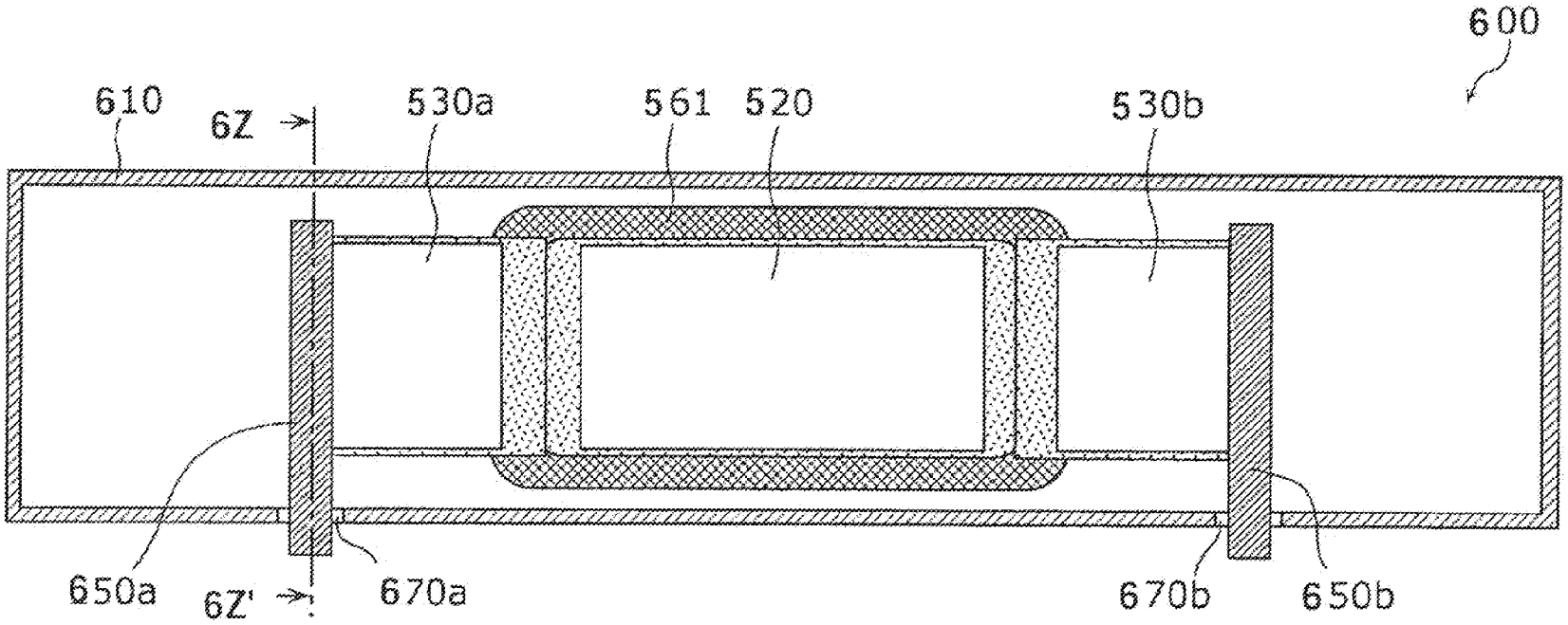
FIG. 27 is a sectional view of FIG. 26 taken along a line 6Y-6Y'.
Figure 28:
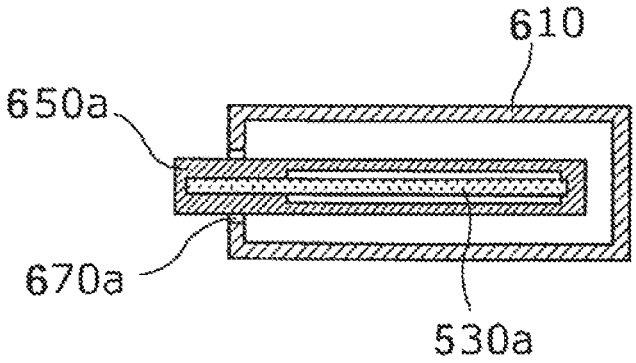
FIG. 28 is a sectional view of FIG. 27 taken along a line 6Z-6Z'.

Referring to FIG. 25 through FIG. 28, a structure of a piezoelectric type loudspeaker 600 according to a sixth embodiment will be described. FIG. 25 is a plan view of the piezoelectric type loudspeaker 600 according to the sixth embodiment. FIG. 26 is a sectional view of the piezoelectric type loudspeaker 600 shown in FIG. 25, taken along a line 6X-6X'. FIG. 27 is a sectional view of the piezoelectric type loudspeaker 600 shown in FIG. 26, taken along a line 6Y-6Y'. FIG. 28 is a sectional view of the piezoelectric type loudspeaker 600 shown in FIG. 27, taken along a line 6Z-6Z'. As shown in FIG. 25 to FIG. 28, the piezoelectric type loudspeaker 600 mainly includes a housing 610, a first piezoelectric diaphragm 520, second piezoelectric diaphragms 530*a* and 530*b*, coupling members 540*a* and 540*b*, fixing members 650*a* and 650*b*, an edge 561, a radiating plate protection film 562, and fillers 670*a* and 670*b*.

The piezoelectric type loudspeaker 600 according to the sixth embodiment differs from the piezoelectric type loudspeaker 500 according to the fifth embodiment in that the fixing members 650*a* and 650*b* are extended to the outside of the housing 610 and connected to a device or a foundation. Hereinafter, description centered on the characteristics will be given, and those in common with the piezoelectric type loudspeaker 500 according to the fifth embodiment are basically omitted.

In the sixth embodiment, the fixing members 650*a* and 650*b* are not directly connected to the housing 610, but pass through gaps (openings) provided in a side surface of the housing 610 and are connected to external fixing means (rigid body) not shown. Also, in the gaps (openings) provided in the housing 610, the fillers 670*a* and 670*b* are filled between the housing 610 and the fixing members 650*a* and 650*b*, respectively. Preferably, the fillers 670*a* and 670*b* are made of materials having low Young's modulus and high internal losses to the housing 610 and the fixing members 650*a* and 650*b*.

According to the above structure, the housing 610 and the fixing members 650*a* and 650*b* are structurally independent of one another. Therefore, even in a case where the piezoelectric type loudspeaker 600 is displaced at large amplitude, the housing 610 is unlikely to be effected by vibrations of the first piezoelectric diaphragm 520 and the second piezoelectric diaphragms 530*a* and 530*b*. Therefore, according to the sixth embodiment, a decrease in sound quality or generation of unusual sounds due to unnecessary resonance of the housing 610 can be avoided without additional provision of measure for vibration isolation.

Also, it is required, in the fifth embodiment, that, for example, the wirings from the signal sources outside the housing 510 to the second piezoelectric diaphragms 530*a* and 530*b* are formed on front surfaces of the fixing members 550*a* and 550*b* or formed in through holes provided inside the fixing members 550*a* and 550*b*, respectively. On the other hand, in the sixth embodiment, for example, by extending the substrates 531*a* and 531*b* of the second piezoelectric diaphragms 530*a* and 530*b* to where the fixing members 650*a* and 650*b* extend externally of the housing 610, the signal sources can be directly connected to the second piezoelectric diaphragms 530*a* and 530*b*. As a result, reduction in number of components can be expected. For both cases of the fifth and sixth embodiments, the wiring to the first piezoelectric diaphragm 520 may be extended from the signal sources via the second piezoelectric diaphragms 530*a* and 530*b*.

Seventh Embodiment

Figure 29:
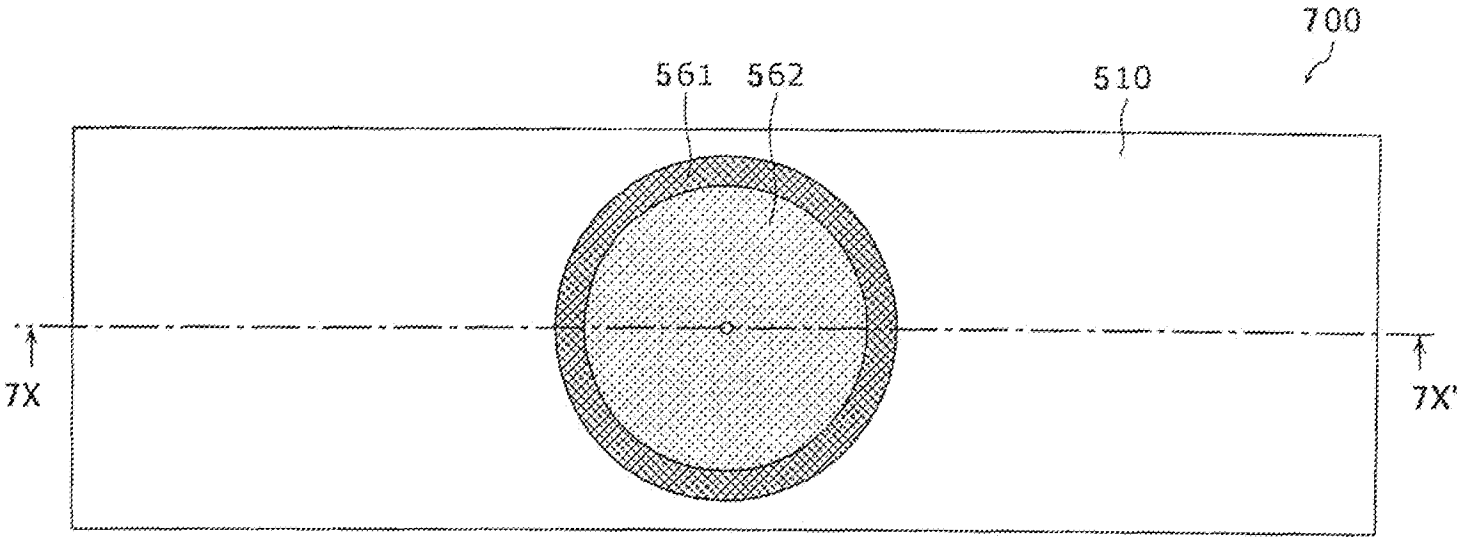
FIG. 29 is a front view of a piezoelectric type loudspeaker according to a seventh embodiment.
Figure 30A:
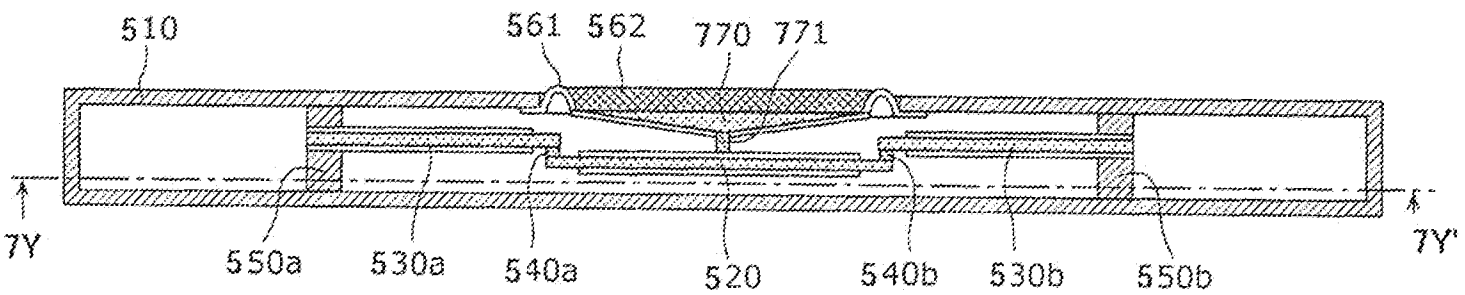
FIG. 30A is a sectional view of FIG. 29 taken along a line 7X-7X'.
Figure 30B:
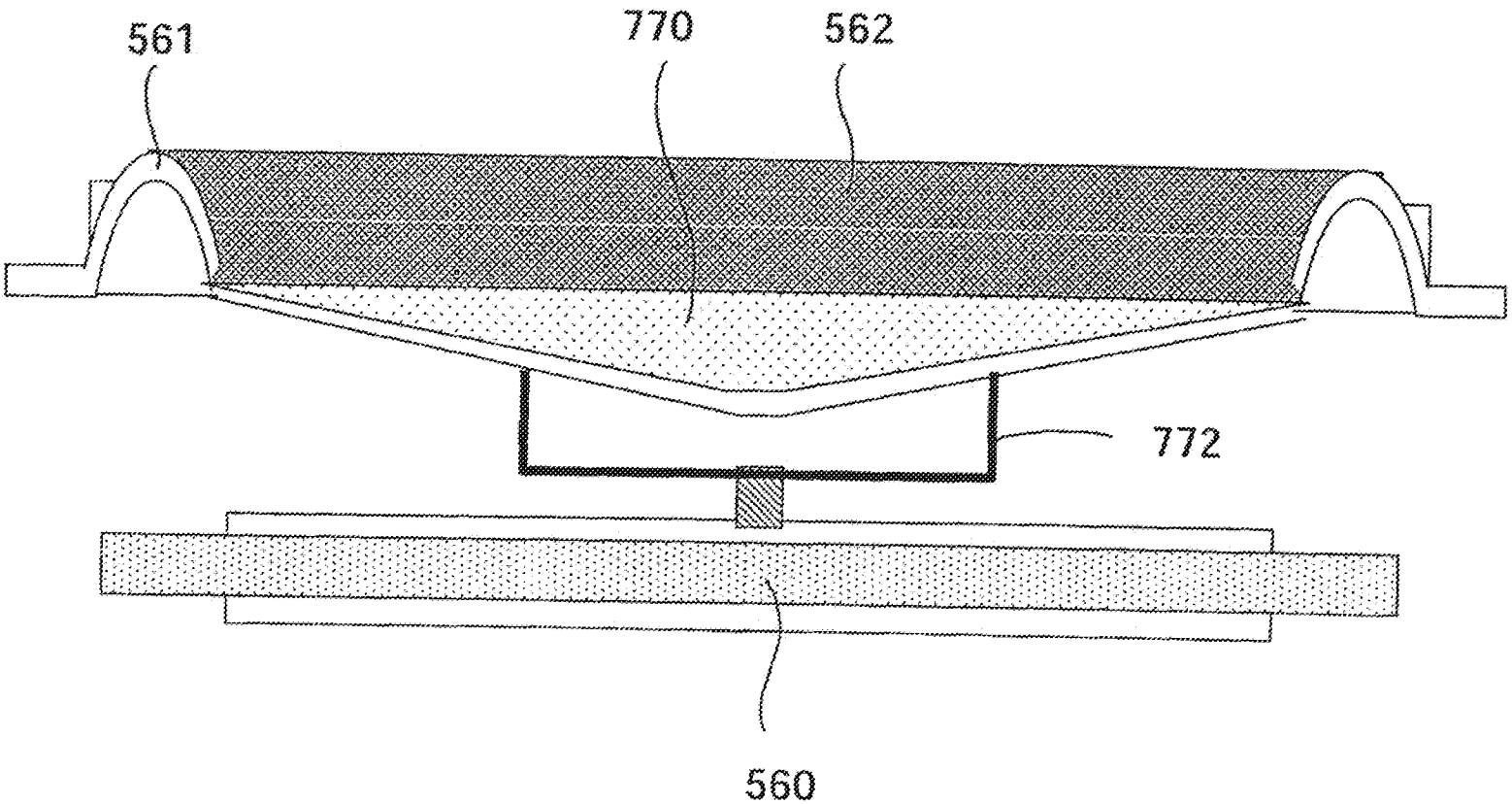
FIG. 30B is a diagram showing another embodiment of a connecting member according to the seventh embodiment.
Figure 31:
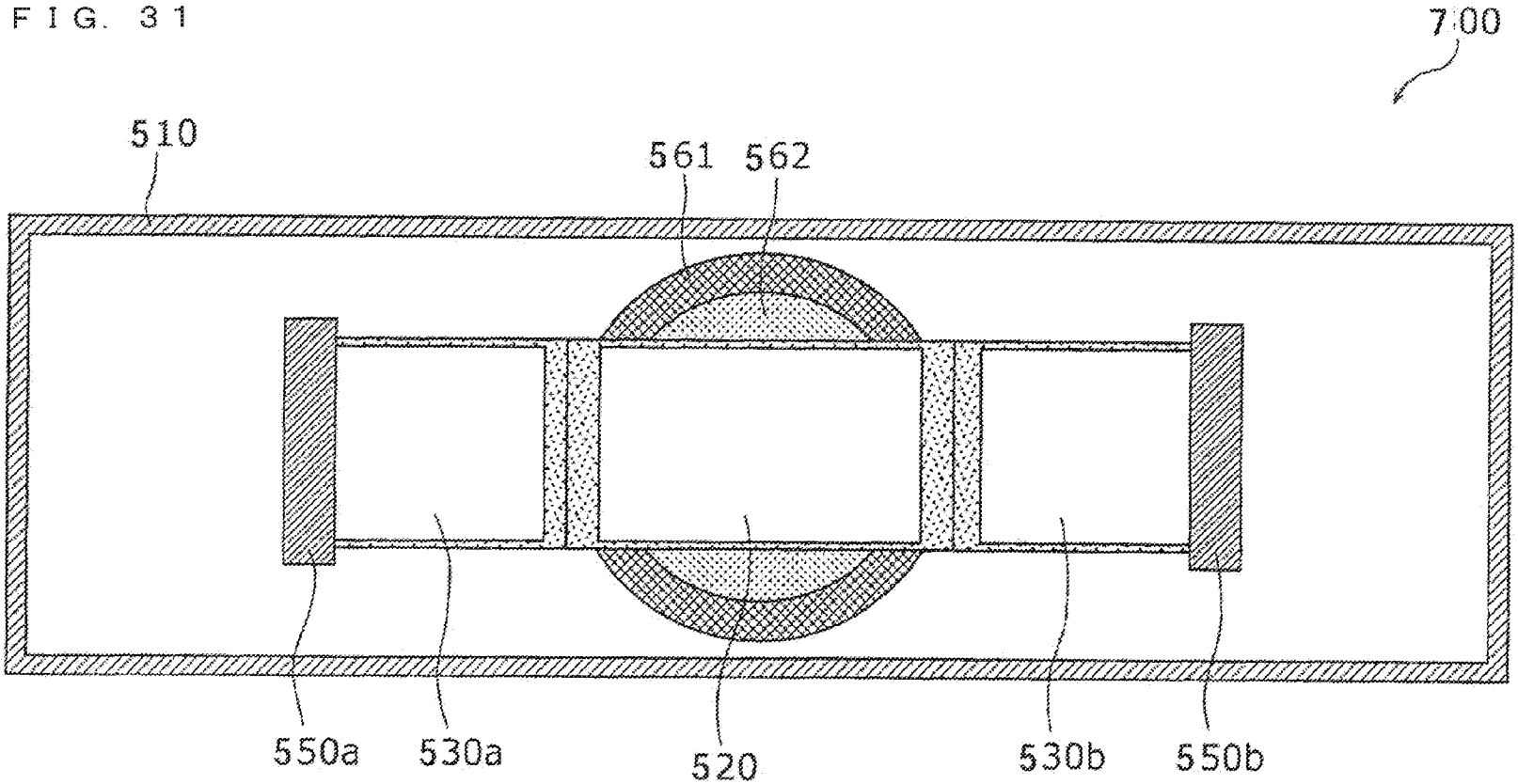
FIG. 31 is a sectional view of FIG. 30A taken along a line 7Y-7Y'.

Referring to FIG. 29 through FIG. 31, a structure of a piezoelectric type loudspeaker 700 according to a seventh embodiment will be described. FIG. 29 is a front view of the piezoelectric type loudspeaker 700 according to the seventh embodiment. FIG. 30A is a sectional view of FIG. 29 taken along a line 7X-7X'. FIG. 30B is a diagram showing another embodiment of the connecting member. FIG. 31 is a sectional view of FIG. 30A taken along a line 7Y-7Y'. As shown in FIG. 29 to FIG. 31, the piezoelectric type loudspeaker 700 mainly includes a housing 510, a first piezoelectric diaphragm 520, second piezoelectric diaphragms 530*a* and 530*b*, coupling members 540*a* and 540*b*, fixing members 550*a* and 550*b*, an edge 561, a radiating plate protection film 562, a diaphragm 770, and a connecting member 771.

The piezoelectric type loudspeaker 700 according to the seventh embodiment differs from the piezoelectric type loudspeaker 500 according to the fifth embodiment in that the diaphragm 770 having a conical shape, which includes no piezoelectric element, is connected to the first piezoelectric diaphragm 520 via the connecting member 771. The diaphragm 770 is used as a radiating plate which serves as a sound wave radiation surface. Hereinafter, description centered on the characteristics will be given, and those in common with the piezoelectric type loudspeaker 500 according to the fifth embodiment are basically omitted.

The diaphragm 770 includes no piezoelectric element, and has a substantially conical shape. That is, the diaphragm 770 differs from the first piezoelectric diaphragm 520 and the second piezoelectric diaphragms 530*a* and 530*b* in that the diaphragm 770 is unable to cause vibration by itself. Thus, the diaphragm 770 is disposed in the opening of the housing 510, and connected to the first piezoelectric diaphragm 520 via the connecting member 771. More specifically, the diaphragm 770 and the first piezoelectric diaphragm 520 are disposed so as to face each other, and are connected to each other by the connecting member 771. As shown in FIG. 30A as an embodiment, the connecting member 771 connects center portions (more preferably, the centers) of facing surfaces of the diaphragm 770 and the first piezoelectric diaphragm 520.

The first piezoelectric diaphragm 520 has largest amplitude at the center portion thereof. Thus, connection of the connecting member 771 to the center portion of the first piezoelectric diaphragm 520, which is a position having largest amplitude, allows vibration of the first piezoelectric diaphragm 520 to be efficiently transmitted to the diaphragm 770. Also, if the connecting member 771 is attached to a position deviated from the center portion of the diaphragm 770, the diaphragm 770 can be caused to vibrate in directions other than a vibration direction (in the up-down direction of FIG. 30A) of the diaphragm 770 due to a biased driving force. Thus, preferably, the connecting member 771 is connected to the center portion of the diaphragm 770 to prevent such vibration.

As shown in FIG. 30B as another embodiment, the connecting member 772 connects a center portion of the first piezoelectric diaphragm 520 to circumferential regions that are equidistant from the center of the diaphragm 770. For example, in a case, as shown in FIG. 30A, where the connecting member 771 substantially makes a point contact with a point at the center portion of the diaphragm 770 and if the diaphragm 770 is vibrated at a high frequency, phase interference caused by split vibrations can occur. Thus, as shown in FIG. 30B, the connecting member 772 on a side facing the diaphragm 770 is formed so as to have conical shapes, and making the conical shaped regions contact with the diaphragm 770 at positions equidistant from the center thereof, thereby effectively preventing the phase interference caused by the split vibrations. Preferably, a position where the connecting member 772 is attached is a position where the phase interference caused by the split vibrations of the diaphragm 770 is unlikely to occur, that is, a position of a node of a vibration mode.

Preferably, the diaphragm 770 has a high rigidity and low density as compared to the substrate materials of the first piezoelectric diaphragm 520 and the second piezoelectric diaphragms 530*a* and 530*b*. Similar to the piezoelectric type loudspeaker 500 according to the fifth embodiment, the first piezoelectric diaphragm 520 and the second piezoelectric diaphragms 530*a* and 530*b* cause the bending deformations in opposite directions. On the other hand, the first piezoelectric diaphragm 520 according to the seventh embodiment is accommodated inside the housing 510 at a position shifted to the rear surface side relative to the second piezoelectric diaphragms 530*a* and 530*b*. That is, a positional relationship between the first piezoelectric diaphragm 520 and the second piezoelectric diaphragms 530*a* and 530*b* is reversed from the case of the piezoelectric type loudspeaker 500 according to the fifth embodiment.

Also, while, the edge 561 is attached on the periphery of the first piezoelectric diaphragm 520 which includes the piezoelectric elements 522 and 523 in the fifth embodiment, the edge 561 is attached on a periphery of the diaphragm 770 disposed in the opening of the housing 510 in the seventh embodiment. According to the seventh embodiment, the diaphragm 770 which includes no piezoelectric element is connected to a position, among positions of the first piezoelectric diaphragm 520 and the second piezoelectric diaphragms 530*a* and 530*b*, where a displacement in the bass range is the largest (that is, a center portion of the first piezoelectric diaphragm 520), and used as a region from which the sound wave is radiated. This allows the entirety of the radiation region to be displaced to a large extent, and thereby the sound pressure can be efficiently obtained. In addition, as compared to the case where the first piezoelectric diaphragm 520 is used as the sound wave radiation region, a bending deformation in the sound wave radiation region can be reduced to a large extent. This makes, even at a high frequency, the phase interference by the split vibrations of the first piezoelectric diaphragm 520 less likely, and prevents deterioration of the sound quality.

Eighth Embodiment

Figure 32:
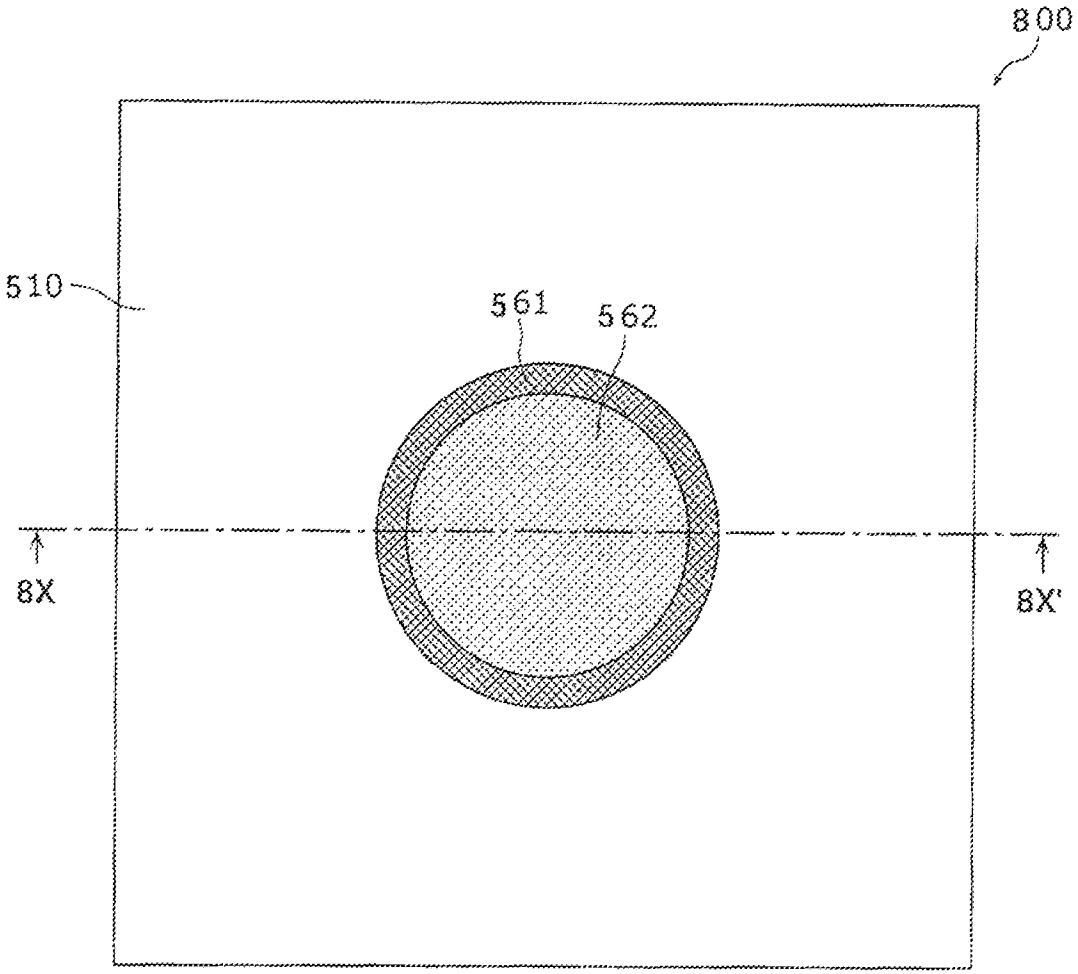
FIG. 32 is a front view of a piezoelectric type loudspeaker according to an eighth embodiment.
Figure 33:
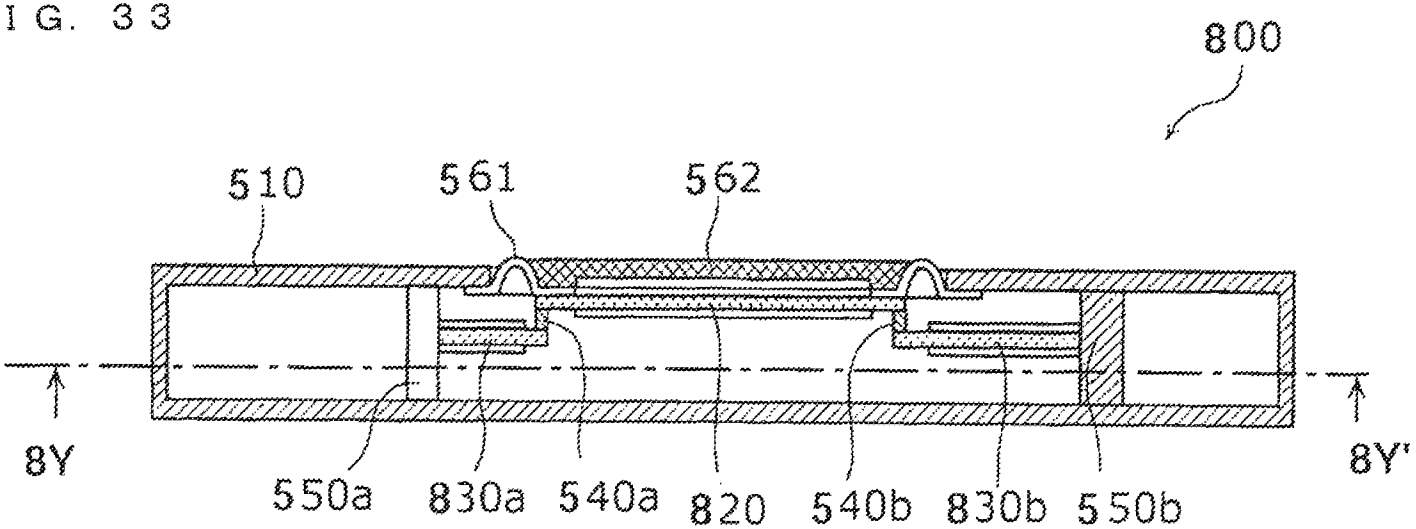
FIG. 33 is a sectional view of FIG. 32 taken along a line 8X-8X'.
Figure 34:
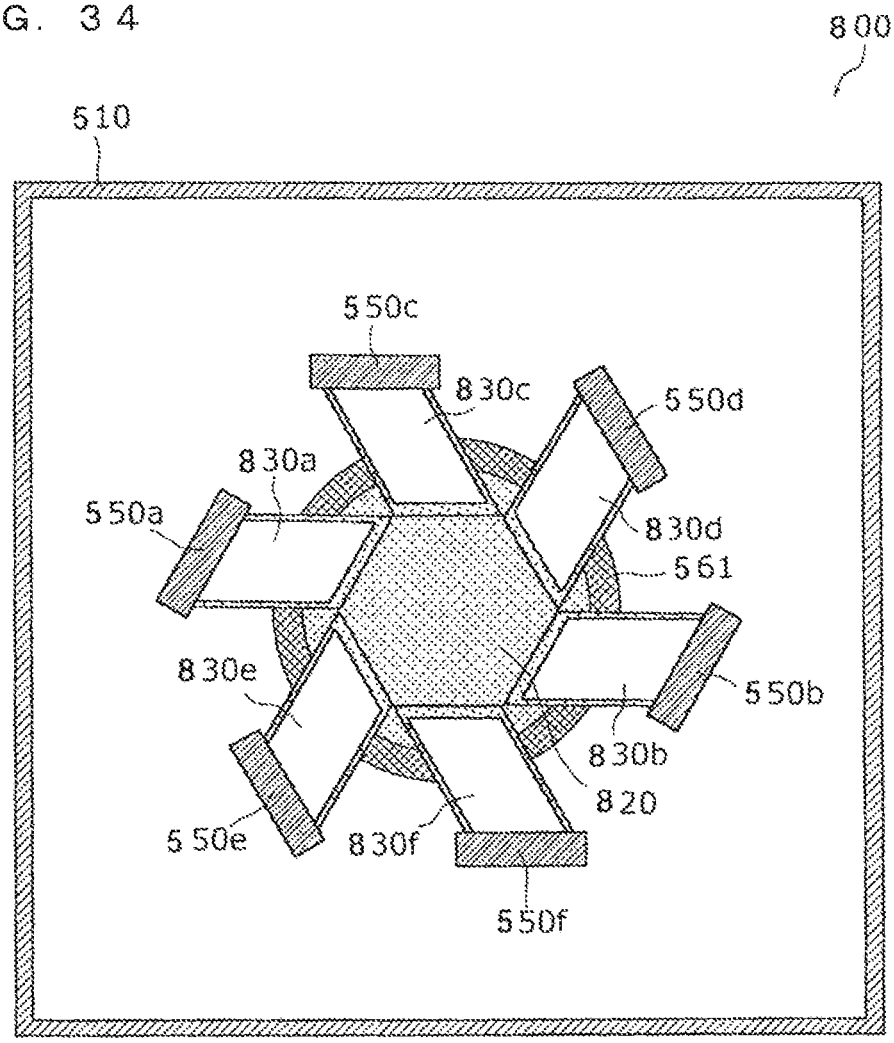
FIG. 34 is a sectional view of FIG. 33 taken along a line 8Y-8Y'.

Referring to FIG. 32 through FIG. 34, a structure of a piezoelectric type loudspeaker 800 according to an eighth embodiment will be described. FIG. 32 is a front view of the piezoelectric type loudspeaker 800 according to the eighth embodiment. FIG. 33 is a sectional view of FIG. 32 taken along a line 8X-8X'. FIG. 34 is a sectional view of FIG. 33 taken along a line 8Y-8Y'.

As shown in FIGS. 32, 33, and 34, the piezoelectric type loudspeaker 800 mainly includes a housing 510, a first piezoelectric diaphragm 820, second piezoelectric diaphragms 830*a*, 830*b*, 830*c*, 830*d*, 830*e*, and 830*f*, coupling members 540*a*, 540*b*, 540*c*, 540*d*, 540*e*, and 540*f* (540*a* and 540*b* are shown), fixing members 550*a*, 550*b*, 550*c*, 550*d*, 550*e*, and 550*f*, an edge 561, and a radiating plate protection film 562.

The piezoelectric type loudspeaker 800 according to the eighth embodiment differs from the piezoelectric type loudspeaker 500 according to the fifth embodiment in that, among the first piezoelectric diaphragm 820 and the second piezoelectric diaphragms 830*a* to 830*f*, the first piezoelectric diaphragm 820 that serves as a sound wave radiation surface has a circular shape, and the second piezoelectric diaphragms 830*a* to 830*f*, which are accommodated inside the housing 510, are radially disposed along the circumference of the first piezoelectric diaphragm 820. Hereinafter, description centered on the characteristics will be given, and those in common with the piezoelectric type loudspeaker 500 according to the fifth embodiment are basically omitted.

In the eighth embodiment, six second piezoelectric diaphragms 830*a* to 830*f* are connected, via the coupling members 540*a* to 540*f*, to a circumferential portion of the first piezoelectric diaphragm 820 that serves as the sound wave radiation surface.

According to the eighth embodiment, the first piezoelectric diaphragm 820 that serves as the sound wave radiation surface has the circular shape, thereby allowing a bending deformation to approximate to be symmetric with a radial axis of the sound wave. This ameliorates, to a higher frequency, an upper limit of a frequency range in which the piezoelectric type loudspeaker 800 can be regarded as a point sound source, and allows readily control, by signal input, as a speaker for realizing desired sound field characteristics.

Ninth Embodiment

Figure 35:
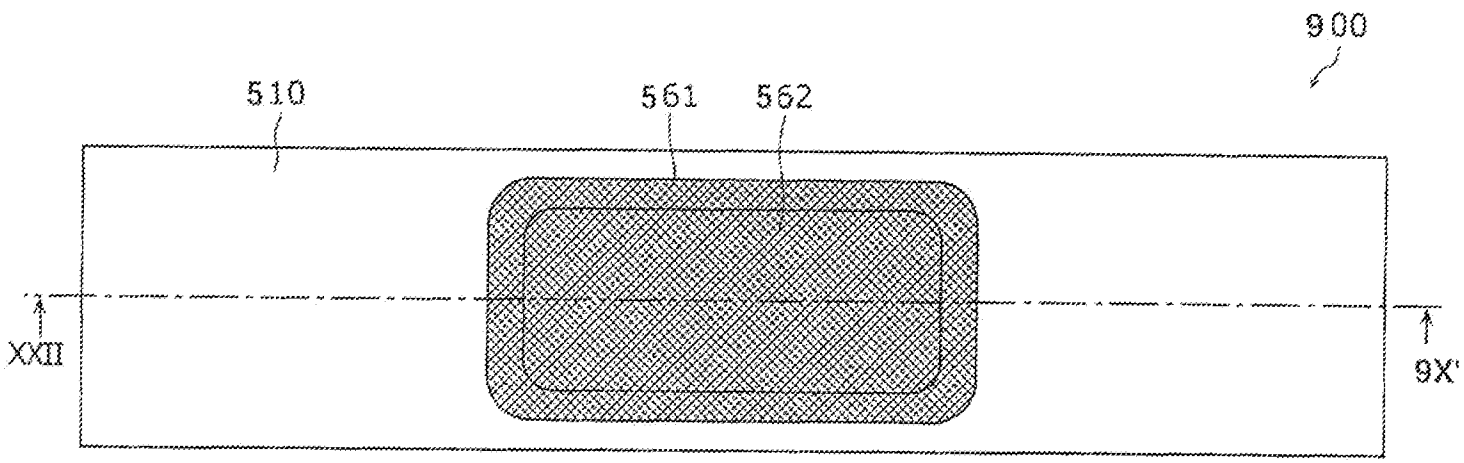
FIG. 35 is a front view of a piezoelectric type loudspeaker according to a ninth embodiment.
Figure 36:
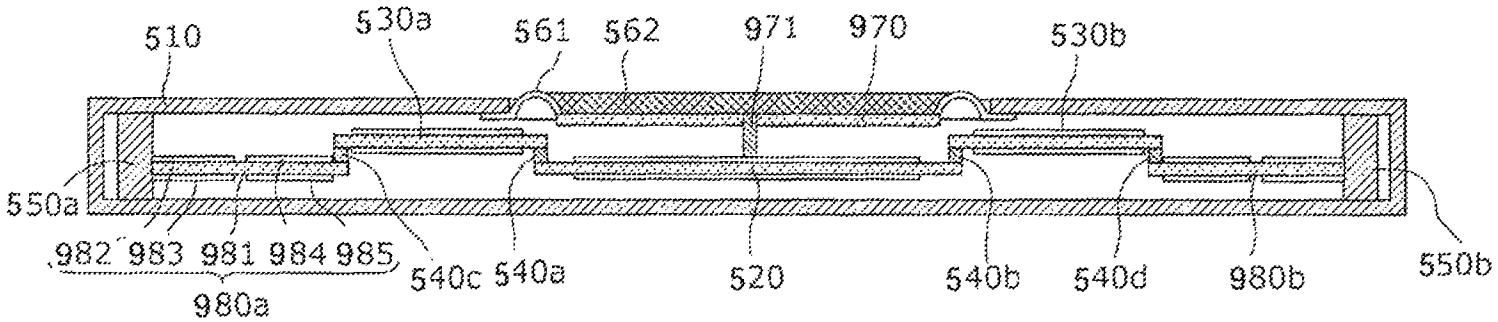
FIG. 36 is a sectional view of FIG. 35 taken along a line 9X-9X'.

Referring to FIG. 35 and FIG. 36, a structure of a piezoelectric type loudspeaker 900 according to a ninth embodiment will be described. FIG. 35 is a front view of the piezoelectric type loudspeaker 900 according to the ninth embodiment. FIG. 36 is a sectional view of FIG. 35 taken along a line 9X-9X'. As shown in FIG. 35 and FIG. 36, the piezoelectric type loudspeaker 900 mainly includes a housing 510, a first piezoelectric diaphragm 520, second piezoelectric diaphragms 530*a* and 530*b*, third piezoelectric diaphragms 980*a* and 980*b*, coupling members 540*a*, 540*b*, 540*c*, and 540*d*, fixing members 550*a* and 550*b*, a diaphragm 970, a connecting member 971, an edge 561, and a radiating plate protection film 562.

The piezoelectric type loudspeaker 900 according to the ninth embodiment differs from the piezoelectric type loudspeaker 500 according to the fifth embodiment in that the diaphragm 970, which has a substantially rectangular flat plate shape and includes no piezoelectric material, is connected to the first piezoelectric diaphragm 520 via the connecting member 971, and also the third piezoelectric diaphragms 980*a* and 980*b* are provided. Hereinafter, description centered on the characteristics will be given, and those in common with the piezoelectric type loudspeaker 500 according to the fifth embodiment are basically omitted.

In the ninth embodiment, the edge 561 is connected to a periphery of the diaphragm 970 which has the substantially rectangular shape and includes no piezoelectric element. Furthermore, center portions of the diaphragm 970 and the first piezoelectric diaphragm 520 are connected to each other via the connecting member 971.

End portions of the first piezoelectric diaphragm 520 are connected to the second piezoelectric diaphragms 530*a* and 530*b* via the coupling members 540*a* and 540*b*, respectively. Furthermore, the second piezoelectric diaphragms 530*a* and 530*b* are connected to the third piezoelectric diaphragms 980*a* and 980*b* via the coupling members 540*c* and 540*d*, respectively.

The third piezoelectric diaphragm 980*a* includes a substrate 981 and four piezoelectric elements 982, 983, 984, and 985. More specifically, on a left side region of the substrate 981, the piezoelectric element 982 and the piezoelectric element 983 are mounted on an upper surface and a lower surface, respectively. On the other hand, on a right side region of the substrate 981, the piezoelectric element 984 and the piezoelectric element 985 are mounted on an upper surface and a lower surface, respectively. A voltage is applied to the third piezoelectric diaphragm 980*a* so that the left side region and the right side region cause bending deformations in opposite directions. Since a configuration of the third piezoelectric diaphragm 980*b* is common with that of the third piezoelectric diaphragm 980*a*, description thereof is omitted.

According to the ninth embodiment, by disposing the first piezoelectric diaphragm 520, the second piezoelectric diaphragms 530*a* and 530*b*, and the third piezoelectric diaphragms 980*a* and 980*b* so that adjacent diaphragms cause bending deformations in opposite directions, a large displacement as a whole can be retained without increasing the bending deformations of individual diaphragms.

Also, the third piezoelectric diaphragms 980*a* and 980*b* that are close to the fixing members 550*a* and 550*b*, respectively, are configured so as to cause, without providing coupling members, bending deformations on the left and right side regions in the opposite directions. On the other hand, the first piezoelectric diaphragm 520 and the second piezoelectric diaphragms 530*a* and 530*b*, which are distanced from the fixing members 550*a* and 550*b* and that have large displacements, are coupled to one another by using the coupling members 540*a* to 540*d*, thereby preventing the first piezoelectric diaphragm 520 and the second piezoelectric diaphragms 530*a* and 530*b* from making contact with the inner wall surfaces of the housing 510 even in a case where internal dimensions of the housing 510 is small.

Tenth Embodiment

Figure 37:
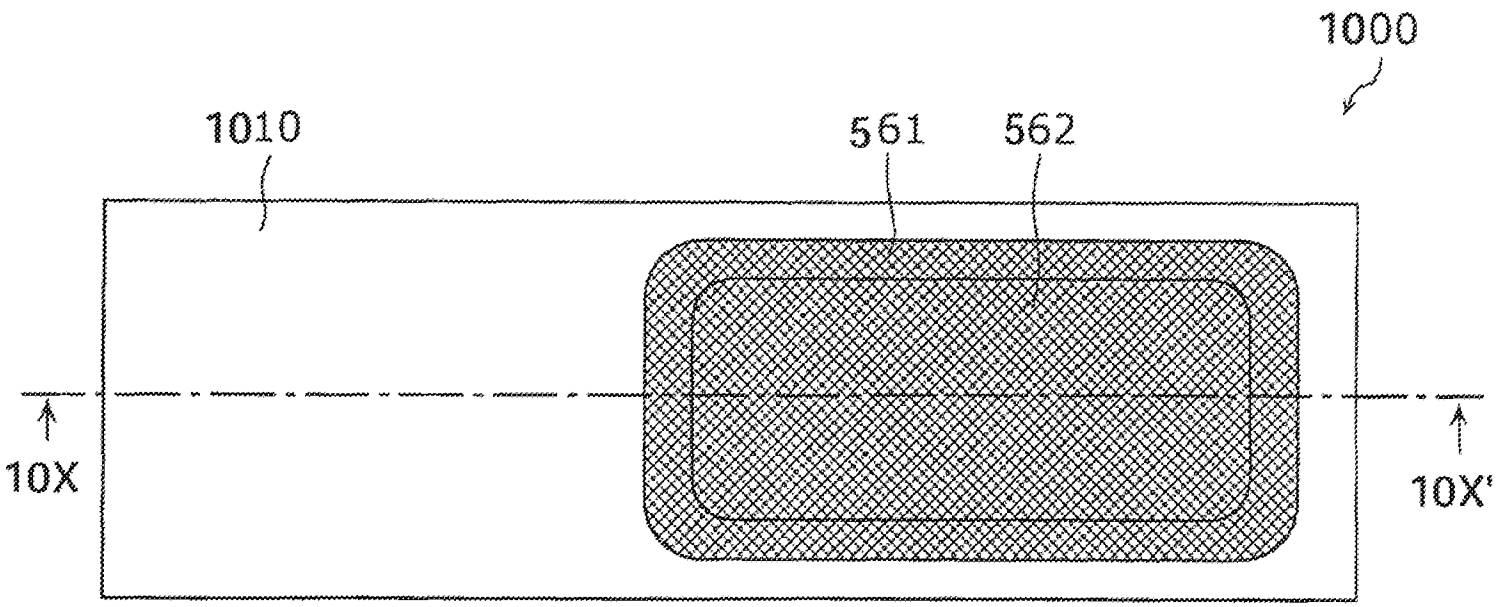
FIG. 37 is a front view of a piezoelectric type loudspeaker according to a tenth embodiment.
Figure 38:
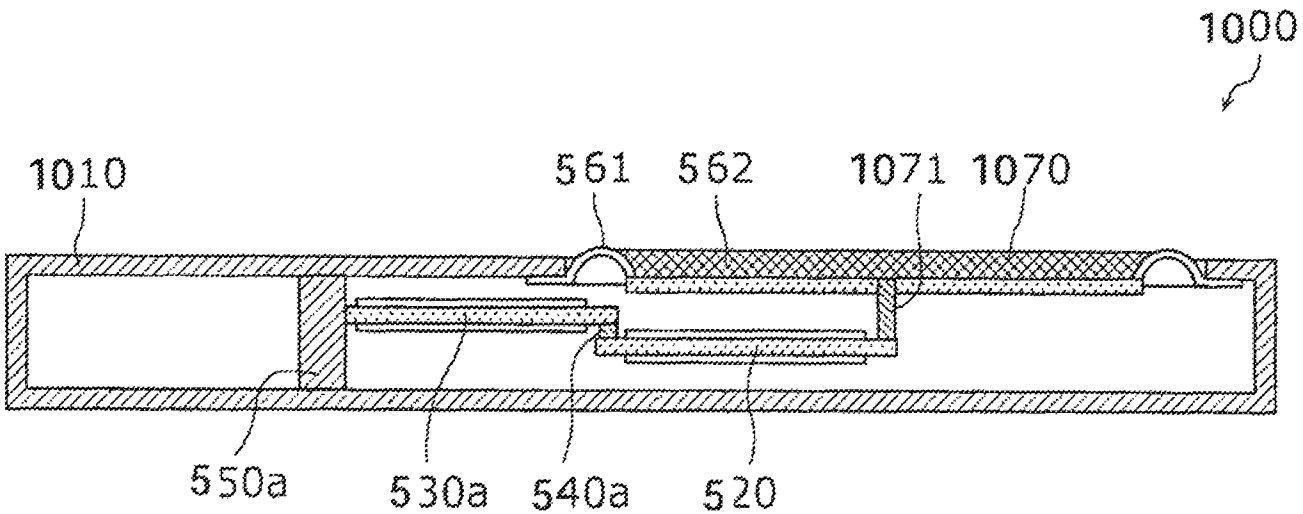
FIG. 38 is a sectional view of FIG. 37 taken along a line 10X-10X'.

Referring to FIG. 37 and FIG. 38, a structure of a piezoelectric type loudspeaker 1000 according to a tenth embodiment will be described. FIG. 37 is a front view of the piezoelectric type loudspeaker 1000 according to the tenth embodiment. FIG. 38 is a sectional view of FIG. 37 taken along a line 10X-10X'. As shown in FIG. 37 and FIG. 38, the piezoelectric type loudspeaker 1000 mainly includes a housing 1010, a first piezoelectric diaphragm 520, a second piezoelectric diaphragm 530*a*, a coupling member 540*a*, a fixing member 550*a*, an edge 561, a radiating plate protection film 562, a diaphragm 1070, and a connecting member 1071.

The piezoelectric type loudspeaker 1000 according to the tenth embodiment differs from the piezoelectric type loudspeaker 500 according to the fifth embodiment in that the diaphragm 1070, which has a substantially rectangular flat plate shape and includes no piezoelectric material, is connected to the first piezoelectric diaphragm 520 via the connecting member 1071, and also the second piezoelectric diaphragm 530*a* is attached to only one side of the first piezoelectric diaphragm 520. Hereinafter, description centered on the characteristics will be given, and those in common with the piezoelectric type loudspeaker 500 according to the fifth embodiment are basically omitted.

The edge 561 is connected to a periphery of the diaphragm 1070 which has a substantially rectangular shape and includes no piezoelectric element. Also, the cantilevered first piezoelectric diaphragm 520 has maximum amplitude at a right end portion thereof, and therefore the connecting member 1071 connects a center portion of the diaphragm 1070 to the right end portion of the first piezoelectric diaphragm 520. Also, the left end portion of the first piezoelectric diaphragm 520 is connected to the second piezoelectric diaphragm 530*a* via the coupling member 540*a*. Furthermore, the left end portion of the second piezoelectric diaphragm 530*a* is fixed to inner wall surfaces on front and rear surface sides of the housing 1010 via the fixing member 550*a*.

Here, the diaphragm 1070 displaces in a sound wave radiation direction only by deformations of the first piezoelectric diaphragm 520 and the second piezoelectric diaphragm 530*a*. At this time, if, for example, the first piezoelectric diaphragm 520 and the second piezoelectric diaphragm 530*a* both cause the bending deformations in the same direction, the right end portion of the first piezoelectric diaphragm 520 have inclination caused by a warp deformation. Therefore, the diaphragm 1070 connected to the right portion of the first piezoelectric diaphragm 520 is prone to inclination or swing in either of the left or right direction, which can cause a problem that a displacement parallel to the sound wave radiation direction is unobtainable.

On the contrary, the first piezoelectric diaphragm 520 and second piezoelectric diaphragm 530*a* of the piezoelectric type loudspeaker 1000 cause deformations in opposite directions, and therefore the right end portion of the first piezoelectric diaphragm 520 does not cause remarkable inclination. From the foregoing, it is possible to cause a large displacement in the piezoelectric type loudspeaker 1000 according to the tenth embodiment, without causing asymmetry with respect to the vibration of the sound wave radiation surface even with a limited number of components.

That is, the piezoelectric type loudspeaker according to the present invention may have the first piezoelectric diaphragm 520 coupled to the plurality of second piezoelectric diaphragms 530*a* and 530*b* as in the fifth embodiment, or may have the first piezoelectric diaphragm 520 coupled to only one second piezoelectric diaphragm 530*a* as in the tenth embodiment.

Also, in the fifth to tenth embodiments, the electric resistance may be connected in series to at least one piezoelectric element included in the piezoelectric type loudspeaker as with the first to fourth embodiments described above. This allows obtainment of effects similar to those of the first to fourth embodiments.

Next, in eleventh to fourteenth embodiments, application examples of the piezoelectric type loudspeakers of the present invention described above will be described.

Eleventh Embodiment

First Application Example

Figure 39:
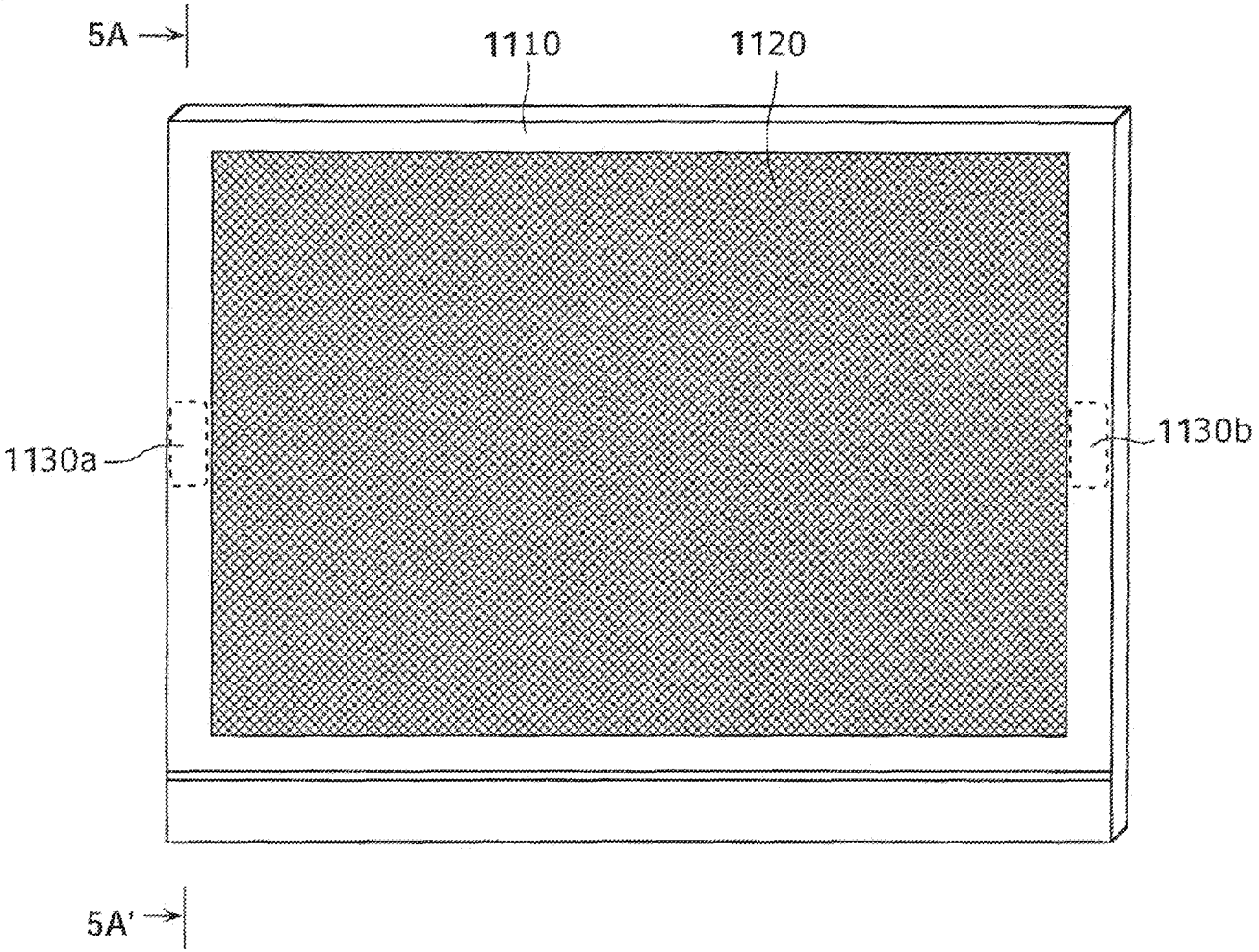
FIG. 39 is an external view of an audio/video device having the piezoelectric type loudspeaker according to each embodiment of the present invention applied thereto.

FIG. 39 is an external view of an audio/video device having the piezoelectric type loudspeaker according to each embodiment of the present invention applied thereto. As shown in FIG. 39, a housing 1110, a display 1120, and piezoelectric type loudspeakers 1130*a* and 1130*b* of the audio/video device are shown. The depth of the housing 1110 is very narrow, and thus a space inside the housing where the speaker is held has narrow depth and small total volume. As a result, the diaphragm displacement is structurally limited and also motion of the diaphragm is inhibited due to an effect of rear air in conventional electrodynamic loudspeakers. Therefore, it is difficult to reproduce bass.

Here, employment of the piezoelectric type loudspeaker and housing structure according to the first to tenth embodiments enables bass reproduction in a desirable manner even if the internal thickness of the speaker housing is small. As an example, assuming a 5A-5A' cross section in FIG. 39 represents FIG. 2B, a large diaphragm displacement is obtainable with a limited housing thickness, and bass is reproduced in a desirable manner. As a result, sound content highly consistent with an image can be provided. Also, according to the piezoelectric type loudspeakers of the first to tenth embodiments, diaphragms on the sound wave radiation side are mainly driven in the treble range, and thus a sound having a wide frequency band can be reproduced by using one speaker unit.

Twelfth Embodiment

Second Application Example

Figure 40:
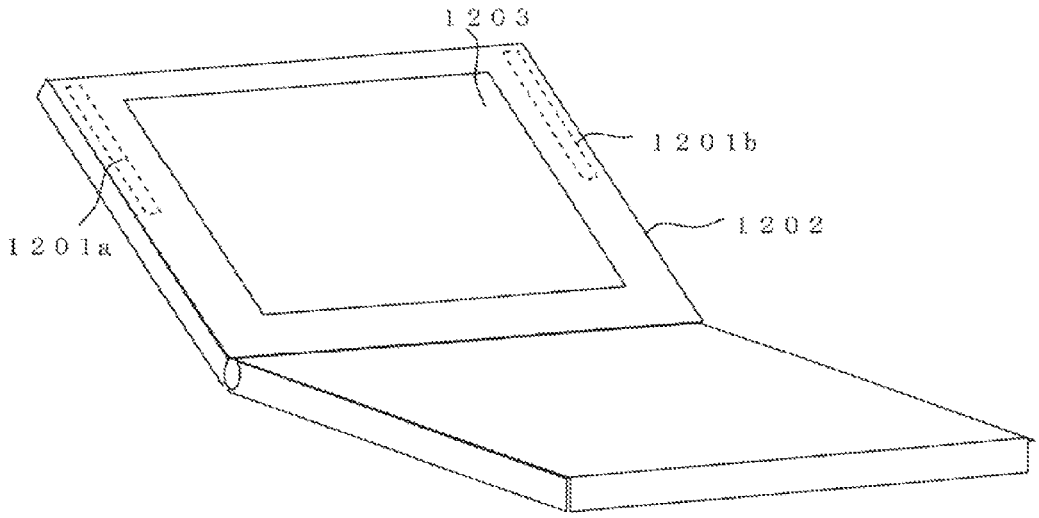
FIG. 40 is an external view of a mobile information appliance having the piezoelectric type loudspeaker of the present invention applied thereto.

FIG. 40 is an external view of a mobile information appliance having the piezoelectric type loudspeaker of the present invention applied thereto. In FIG. 40, a housing 1202 and a display 1203 of the mobile information appliance, and the piezoelectric type loudspeakers 1201*a* and 1201*b* of the present invention are shown. As shown in FIG. 40, the piezoelectric type loudspeaker 1201*a* and 1201*b* of the present invention are disposed on both sides of the display 1203. Here, as described in the first to tenth embodiments, the piezoelectric type loudspeakers 1201*a* and 1201*b* of the present invention can realize space-saving and high quality sound without increasing the number of components. Thus, according to the present invention, mobile information appliances which achieve both a design suitable for portability and reproduction of a sound content in a desirable manner are easy to design.

Thirteenth Embodiment

Third Application Example

Figure 41:
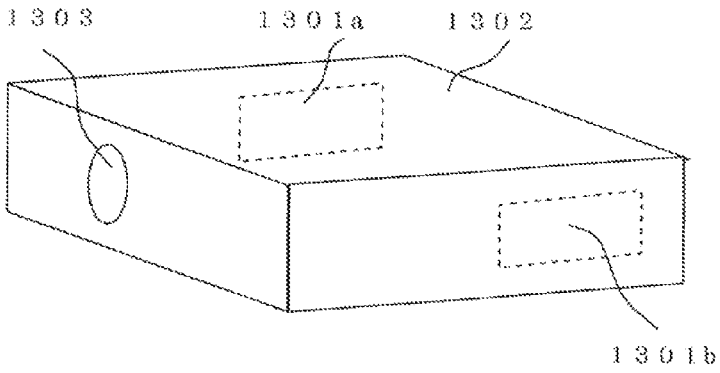
FIG. 41 is an external view of a portable image projection apparatus having the piezoelectric type loudspeaker of the present invention applied thereto.

FIG. 41 is an external view of a portable image projection apparatus having the piezoelectric type loudspeaker of the present invention applied thereto. In FIG. 41, a housing 1302, a projector 1303 of the portable image projection apparatus, and piezoelectric type loudspeakers 1301 of the present invention are shown. As shown in FIG. 41, the piezoelectric type loudspeakers 1301 of the present invention are disposed on both sides of the housing 1302. Typically, room for a drive circuit and hear radiation circuit of the projector is required in the portable image projection apparatus, and therefore there is remarkable limitation regarding room for components. Here, the piezoelectric type loudspeakers 1301 of the present invention can achieve space-saving and high quality sound without increasing the number of components, as described in the first to tenth embodiments. According to the present invention, a portable image projection apparatus which has a design suitable for portability and is suitable for viewing audio/video content by a number of people is easy to design.

Fourteenth Embodiment

Fourth Application Example

Figure 42:
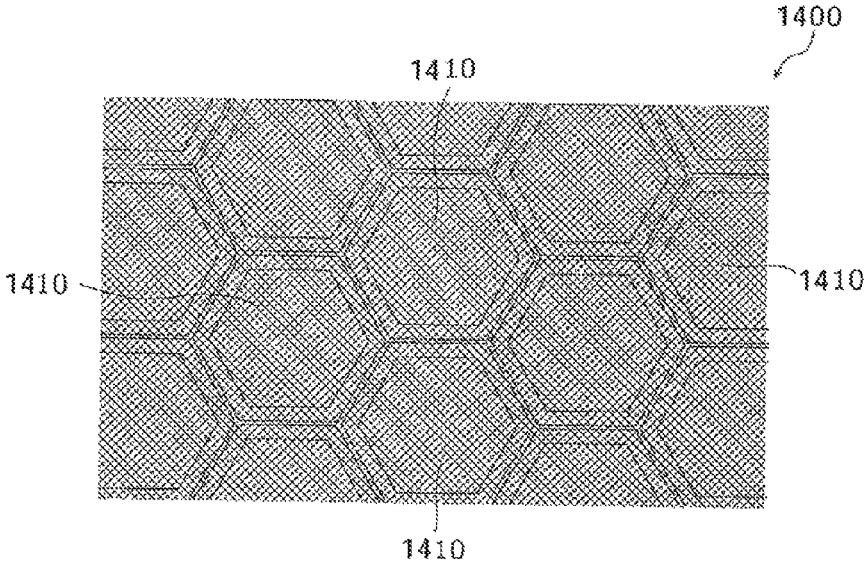
FIG. 42 is a schematic view showing part of an array speaker module having the piezoelectric type loudspeaker according to each embodiment of the present invention applied thereto.
Figure 43:
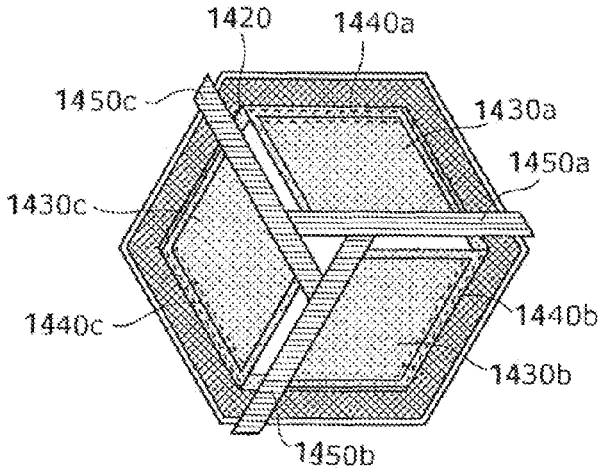
FIG. 43 is a diagram showing a piezoelectric type loudspeaker unit from a bottom surface side thereof.
Figure 44:
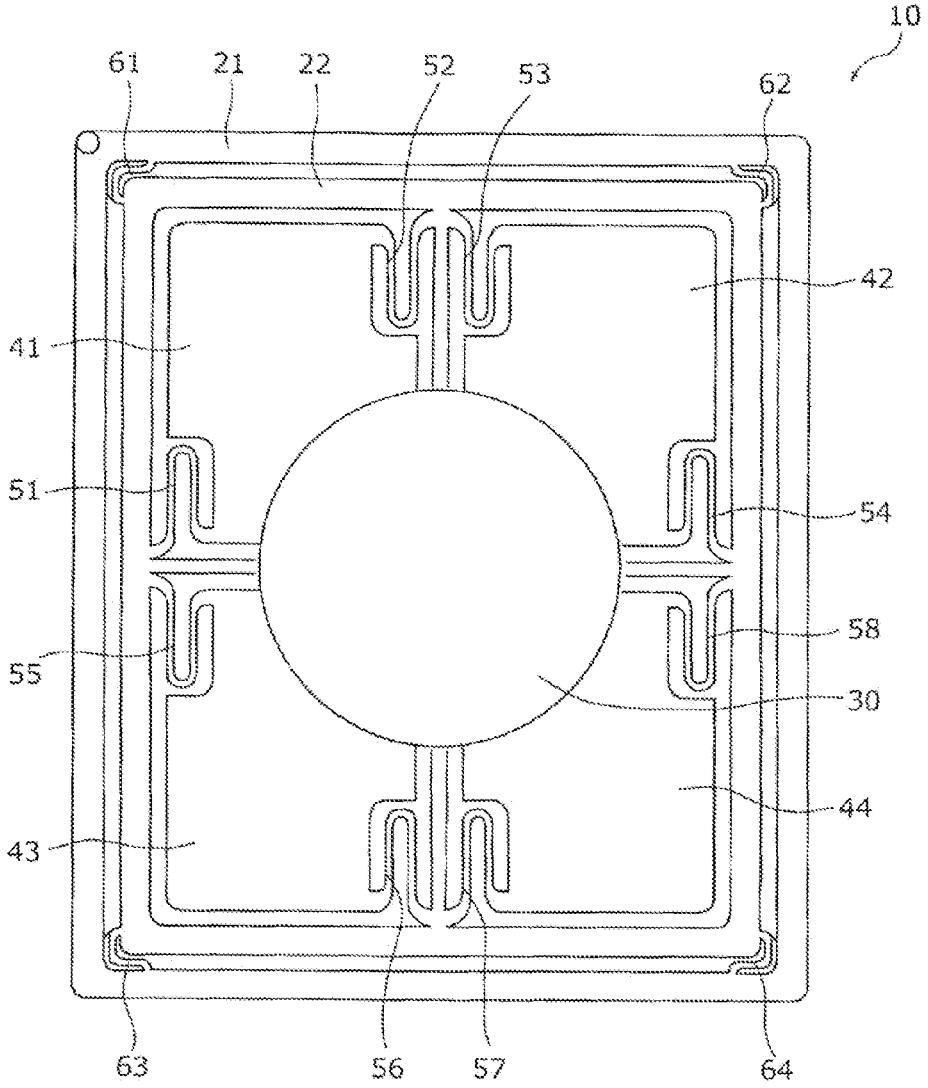
FIG. 44 PRIOR ART
FIG. 44 is an external view of a conventional piezoelectric type loudspeaker.

FIG. 42 is a schematic view showing part of an array speaker module 1400 having the piezoelectric type loudspeaker according to each embodiment of the present invention applied thereto. FIG. 42 is a diagram viewing the piezoelectric type loudspeaker units 1410 from rear surface sides thereof. As shown in FIG. 42, the array speaker module 1400 is configured of a combination of a plurality of piezoelectric type loudspeaker units 1410. More specifically, the piezoelectric type loudspeaker units 1410 each have a substantially hexagonal shape, and adjacent piezoelectric type loudspeaker units 1410 are disposed so as to share a side.

The piezoelectric type loudspeaker units 1410 each have an edge 1461 connected to a periphery of a first piezoelectric diaphragm 1420 which serves as a sound wave radiation surface. The first piezoelectric diaphragm 1420 is connected to second piezoelectric diaphragms 1430*a*, 1430*b*, and 1430*c* via coupling members 1440*a*, 1440*b* and 1440*c*, respectively, which are indicated by dotted lines. The second piezoelectric diaphragms 1430*a*, 1430*b*, and 1430*c* are fixed to a housing (not shown) via fixing members 1450*a*, 1450*b*, and 1450*c*, respectively. One ends of the three fixing members 1450*a* to 1450*c* are integrally connected to one another at positions facing a center portion of the first piezoelectric diaphragm 1420, and the other ends are connected to an external frames not shown.

Here, unlike the first to tenth embodiments, the fourteenth embodiment has the first piezoelectric diaphragm 1420 and the second piezoelectric diaphragms 1430*a*, 1430*b*, and 1430*c* disposed facing each other. Because of this, disposition area exceeding an area of a sound wave radiation region is unnecessary, and a plurality of piezoelectric type loudspeaker units 1410 can be arrayed at minimal intervals therebetween. As a result, a sound field assumed for the array speaker module 1400 can be faithfully reproduced in a wide frequency band.

In the thirteenth and fourteenth embodiments, the examples, where the piezoelectric type loudspeaker of the present invention is applied for an acoustic content reproduction at home, are shown. The piezoelectric type loudspeaker of the present invention, however, is used, not limiting to home use, and may be applied to, for example, car audio systems or notification systems for people movers, and the like which require reduction in thickness and weight and also require bass reproduction. In addition, the size of the piezoelectric type loudspeaker of the present invention is not limited to that so as to be mounted as a woofer of typical audio-visual equipment or as a midrange speaker, and the piezoelectric type loudspeaker of the present invention may be applied to speakers corresponding to sizes whereby the speaker is solely employed as a subwoofer or corresponding to small sizes such as earphone receivers.

In the embodiments described above, the examples are shown in which the present invention is applied as the piezoelectric type loudspeaker for radiating the sound wave into the air. The present invention, however, is not limited to the case as being used to radiate the sound wave into the air, and may be used as, for example, an actuator which controls vibration of a structure or indirectly controls vibration of a solid or fluid by acoustic excitation. Effects by the present invention can be obtained by operating the piezoelectric diaphragm, which is configured herein to operate as the sound wave radiation surface, as an exciting surface making contact with a target to be excited.

Also, in the above embodiments, the present invention is applied as means which converts an electrical signal as an input to a mechanical vibration and a sound wave. However, the present invention may be applied to other piezoelectric transducers and may be applied to sensors and microphones.

While the embodiments of the present invention have been described above with reference to the drawings, the present invention is not limited to the embodiments shown in the drawings. Various corrections and modifications are possible to the illustrated embodiments within the same scope of the present invention or within the scope of equivalent matters.

INDUSTRIAL APPLICABILITY

The present invention can be used in piezoelectric acoustic transducers, and particularly useful in realizing power-saving while achieving both space-saving and enhancement of bass reproduction capability in the piezoelectric type loudspeaker, or useful in preventing deterioration of the sound quality caused by an effect by speaker cabinets.

DESCRIPTION OF THE REFERENCE CHARACTERS

| | |
|---|---|
| 101, 201, 301, 401, 500, 600, 700, 800, 900, 1000, 1130a, 1130b, 1201a, 1201b, 1301, 1410 | piezoelectric type loudspeaker |
| 102, 202, 302, 402, 510, 610, 1010, 1110, 1202, 1302 | housing |
| 103, 203, 303 | edge |
| 104, 204, 304 | upper piezoelectric diaphragm |
| 105, 205, 305 | lower piezoelectric diaphragm |
| 107, 110, 207, 210, 305, 309a, 309b | substrate |
| 108, 109, 111, 112, 306, 307, 310a, 310b, 311a, 311b | piezoelectric element |
| 106a, 106, 106c, 106d, 206a, 206b, 206c, 206d, 312a, 312b, 312c, 312b | coupling member |
| 113, 213, 313a, 313b | fixing member |
| 3A, 3D | substrate-side electrode layer |
| 3B, 3C | electrically resistive layer |
| 114, 115, 116, 117 | external continuity means |
| 1120, 1203 | display |
| 703 | projector |
| 10 | piezoelectric type loudspeaker |
| 21 | outer frame |
| 22 | inner frame |
| 30 | piezoelectric element |
| 41, 42, 43, 44 | diaphragm |
| 51, 52, 53, 54, 55, 56, 57, 58 | damper |
| 61, 62, 63, 64 | edge |

The invention claimed is:

1. A piezoelectric acoustic transducer comprising:

a housing having an opening formed in a wall surface;

a plurality of diaphragms including at least a first piezoelectric diaphragm and a second piezoelectric diaphragm which vibrate in opposite phases by having a voltage applied thereto;

at least one coupling member for coupling the first piezoelectric diaphragm and the second piezoelectric diaphragm with each other in a thickness direction; and a fixing member for fixing at least one of the first and second piezoelectric diaphragms to the housing, wherein one of the plurality of diaphragms is disposed in the opening of the housing so that a surface on one side faces outside the housing, and a surface on the other side faces inside the housing, the one of the plurality of diaphragms radiating a sound wave by vibrating at amplitude obtained by combining amplitude of the first and second piezoelectric diaphragms, each of the first piezoelectric diaphragm and the second piezoelectric diaphragm comprises a substrate and at least one piezoelectric element disposed on at least one of a front surface and a rear surface of the substrate, the piezoelectric element expanding or contracting by having a voltage applied thereto, and electric resistance is connected in series to the at least one piezoelectric element.

2. The piezoelectric acoustic transducer according to claim 1, wherein a value of the electric resistance is defined by electrostatic capacity of the piezoelectric element and either a second lowest resonant frequency or a third lowest resonant frequency, among mechanical resonant frequencies of the piezoelectric acoustic transducer.

3. The piezoelectric acoustic transducer according to claim 1, wherein at least one of the diaphragms has an edge made of a pliable material on a periphery, the at least one of the diaphragms operates as a sound wave radiation surface, and the edge is connected to an external frame.

4. The piezoelectric acoustic transducer according to claim 3, wherein a value of the electric resistance is defined by electrostatic capacity of the piezoelectric element and a lowest frequency among frequencies having both positive and negative values for magnitudes of displacements in a sound wave radiation direction on the diaphragm, which operates as the sound wave radiation surface, at points on the diaphragm when the electric resistance is not connected.

5. The piezoelectric acoustic transducer according to claim 1, wherein the electric resistance is connected in series to the piezoelectric element on the piezoelectric diaphragm fixed by the fixing member.

6. The piezoelectric acoustic transducer according to claim 1, wherein the electric resistance is formed on a front surface of or inside the coupling member.

7. The piezoelectric acoustic transducer according to claim 1, wherein the electric resistance is formed on a front surface of the substrate.

8. The piezoelectric acoustic transducer according to claim 3, wherein the electric resistance is formed on a front surface of or inside the external frame.

9. The piezoelectric acoustic transducer according to claim 1, wherein the first piezoelectric diaphragm is disposed in the opening of the housing and operates as a radiating plate, and the second piezoelectric diaphragm is accommodated inside the housing.

10. The piezoelectric acoustic transducer according to claim 1, wherein the plurality of diaphragms include a radiating plate which vibrates at combined amplitude transmitted from the first piezoelectric diaphragm, the radiating plate being connected to the first piezoelectric diaphragm in a positional relationship in which the radiating plate is shifted from the plurality of diaphragms in the thickness direction, and the first and second piezoelectric diaphragms are accommodated inside the housing.

11. The piezoelectric acoustic transducer according to claim 10, wherein the radiating plate and the first piezoelectric diaphragm are disposed so as to face each other, the piezoelectric acoustic transducer further includes a connecting member for connecting with each other the radiating plate and a portion of the first piezoelectric diaphragm where amplitude is largest.

12. The piezoelectric acoustic transducer according to claim 9, wherein the fixing member fixes the second piezoelectric diaphragm to inner wall surfaces of the housing.

13. The piezoelectric acoustic transducer according to claim 9, wherein the piezoelectric acoustic transducer further includes a fixing member, which extends into and out of the housing through a gap provided in the housing, for fixing the second piezoelectric diaphragm to a rigid body outside the housing.

14. The piezoelectric acoustic transducer according to claim 1, wherein the first and second piezoelectric diaphragms are each formed in a substantially rectangular shape having long sides and short sides, and the coupling member is a member having an elongated shape, extending along the short sides of the first and second piezoelectric diaphragms to couple the short sides of the first and second piezoelectric diaphragms.

15. The piezoelectric acoustic transducer according to claim 1, wherein the first and second piezoelectric diaphragms are each formed in a substantially rectangular shape, and the coupling member couples corners of the first and second piezoelectric diaphragms.

16. The piezoelectric acoustic transducer according to claim 1, wherein a bending rigidity of the coupling member in a direction intersecting with a main surface of the radiating plate is larger than a bending rigidity of the first and second piezoelectric diaphragms in a main surface direction.

17. The piezoelectric acoustic transducer according to claim 1, wherein wiring for connecting a signal source and the piezoelectric element with each other is printed on the substrate surface upon which the piezoelectric element is disposed.

18. The piezoelectric acoustic transducer according to claim 17, wherein the wiring extends from the signal source, passing through each of the first and second piezoelectric diaphragms from one side to the other side, and establishes continuity between the piezoelectric element of the first piezoelectric diaphragm and the piezoelectric element of the second piezoelectric diaphragm.

19. The piezoelectric acoustic transducer according to claim 18, wherein the wiring passes through a through hole formed on a surface of the coupling member or inside the coupling member, and extends from the one side of each of the first and second piezoelectric diaphragms to the other side.

20. The piezoelectric acoustic transducer according to claim 1, wherein the piezoelectric acoustic transducer is comprised of a pliable material, and includes a sealing member for sealing a gap between the radiating plate and the opening of the housing.

* * * * *